US005474187A

United States Patent [19]

Taylor et al.

[11] Patent Number: 5,474,187

[45] Date of Patent: Dec. 12, 1995

[54] CLOTHING ACCESSORY ORGANIZER

[75] Inventors: Charles E. Taylor, San Rafael, Calif.; Blaine M. Smith, Lincoln City, Oreg.

[73] Assignee: The Sharper Image Corporation, San Francisco, Calif.

[21] Appl. No.: 129,602

[22] Filed: Sep. 29, 1993

[51] Int. Cl.[6] ..... A47F 3/08

[52] U.S. Cl. ..... 211/1.56; 211/13; 211/122; 198/678.1

[58] Field of Search ..... 24/121, 122, 1.56, 24/13; 198/465.2, 678.1, 685; 318/445, 452; 248/230, 225.31, 214

[56] References Cited

U.S. PATENT DOCUMENTS

| | | | |
|---|---|---|---|
| D. 229,909 | 1/1974 | Goldfeder | D6/117 |
| D. 298,591 | 11/1988 | Arner et al. | D6/315 |
| 2,275,749 | 3/1942 | Fisher | 211/163 |
| 3,339,744 | 9/1967 | Ginsberg | 211/1.5 |
| 4,097,791 | 6/1978 | Bivens et al. | 318/452 X |
| 4,742,924 | 5/1988 | Tarlow et al. | 211/60.1 |
| 5,191,984 | 3/1993 | Kon et al. | 211/115 |

OTHER PUBLICATIONS

"Photographs of The Sharper Image, Inc. MTR 601 Motorized Tie Rack", Dec. 1993, Exhibits 1–24.

The Sharper Image, Inc., "MTR 601 Instruction Manual", date unknown all pages.

The Sharper Image, Inc., "MTR 601 Package Illustrations", date unknown, all pages.

The Sharper Image, Inc., "The Sharper Image Catalog", Feb. 1993, p. 54.

The Sharper Image, Inc., "Annual Report 1991", date unknown, p. 9.

The Sharper Image, Inc., "MTR 601 Production Drawings", date unknown, all pages.

*Primary Examiner*—Blair M. Johnson

*Attorney, Agent, or Firm*—Flehr, Hohbach, Test, Albritton & Herbert

[57] ABSTRACT

An apparatus for organizing articles of clothing is disclosed. The apparatus includes a housing having first and second drums rotatably mounted thereto. A belt is engaged around the first and second drums that has a plurality of first hook members for hanging articles thereon. A drive system is used for rotating one of the first and second drums, and an automatic control system activates the drive system for a period of time approximately equal to a motor delay time period. In another embodiment, the apparatus includes an electric motor and a pulley and gear system for rotating one of the first and second drums. An electric switch is mounted to the housing and coupled to the electric motor. In another embodiment, the apparatus includes a light bulb mounted to the housing for illuminating articles hanging on the first hook members and an automatic lighting means for providing electricity to the light bulb for approximately a lamp delay time period. In another embodiment, the apparatus includes a clamp for clamping the housing to a closet rod. The clamp has a bolt that has its longitudinal axis positioned substantially parallel to the axes of the drums so that the bolt is capable of penetrating into a cylindrical cavity in the housing. The bolt is countersunk into the housing between the first drum, the second drum, and the belt.

65 Claims, 18 Drawing Sheets

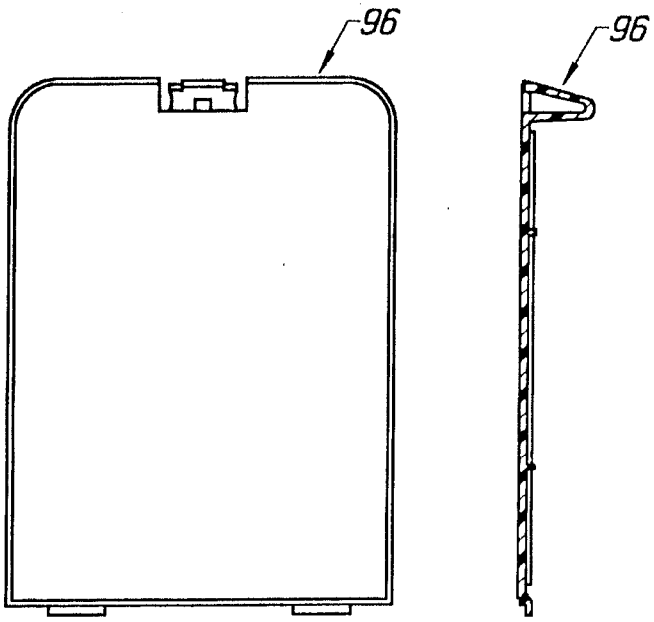
FIG. 9A
FIG. 9E
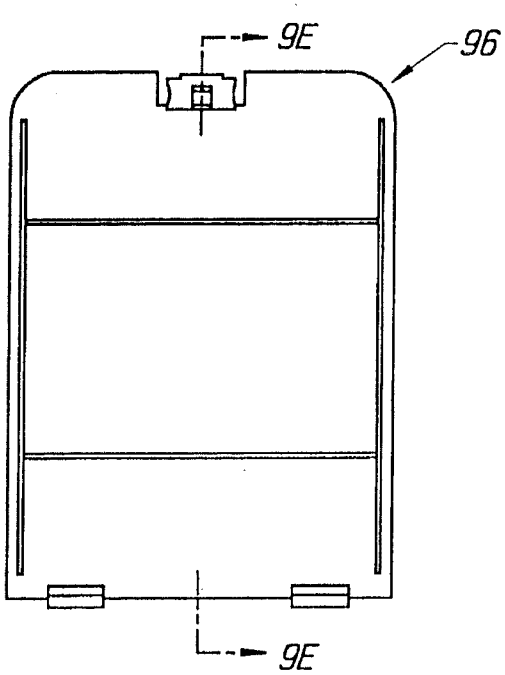
FIG. 9B
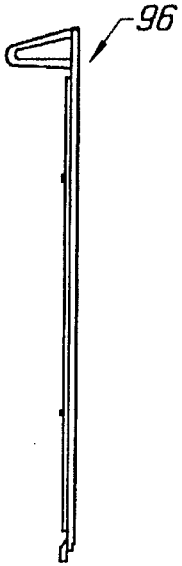
FIG. 9C
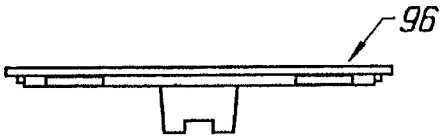
FIG. 9D

CLOTHING ACCESSORY ORGANIZER

BACKGROUND OF THE INVENTION

1. Field of the Invention

The present invention relates to clothing and garment storage systems, and more particularly, to an apparatus for organizing clothing accessories such as neckties, scarves, belts, and the like.

2. Description of the Related Art

The storage of clothing accessories, such as neckties, scarves, belts, and other similar articles, is difficult because such accessories are typically flexible and have narrow widths and long lengths. Various static devices, such as conventional clothing hangers, hooks, rods, and the like, have been used to store clothing accessories. These static devices suffer from the disadvantage that the accessories are positioned very close together, often overlapping, such that an individual accessory cannot be located and retrieved without disturbing, or even removing, other accessories.

Various dynamic devices, such as those disclosed in U.S. Pat. Nos. 2,275,749 to Fisher, 4,742,924 to Tarlow et al., Des. 229,909 to Goldfeder, and Des. 298,591 to Arner et al., have also been used to store clothing accessories. However, these dynamic devices suffer from a number of disadvantages, a few of which are inadequate control for easy location and retrieval of accessories, inadequate lighting, difficult installation, and inefficient use of space.

Thus, there is a need for an apparatus for storing clothing accessories which overcomes the disadvantages of the above mentioned static and dynamic devices.

SUMMARY OF THE INVENTION

The present invention provides an apparatus for organizing articles of clothing. The apparatus includes a housing having first and second drums rotatably mounted thereto. A belt is engaged around the first and second drums. The belt has a plurality of first hook members for hanging articles thereon that are formed integral with the belt. A drive system is used for rotating one of the first and second drums to cause rotation of the belt. An automatic control system activates the drive system for a period of time approximately equal to a motor delay time period.

In another embodiment of the present invention, an apparatus for organizing articles of clothing includes a housing having first and second drums rotatably mounted thereto. A belt is engaged around the first and second drums. The belt has a plurality of first hook members for hanging articles thereon. An electric motor having an output shaft is mounted to the housing. A pulley and gear system is connected between the output shaft of the electric motor and one of the first and second drums for rotating one of the first and second drums to cause rotation of the belt. An electric switch is mounted to the housing and coupled to the electric motor. The electric switch has three positions for switching the electric motor off, switching the electric motor on so that its output shaft rotates clockwise, and switching the electric motor on so that its output shaft rotates counter-clockwise. An automatic control system automatically switches the electric motor off after a motor delay time period in response to the electric switch being switched to one of the on positions.

In another embodiment of the present invention, an apparatus for organizing articles of clothing includes a housing having first and second drums rotatably mounted thereto. A belt is engaged around the first and second drums that has a plurality of first hook members for hanging articles thereon. An electric motor having an output shaft is mounted to the housing. A pulley and gear system is connected between the output shaft of the electric motor and one of the first and second drums for rotating one of the first and second drums to cause rotation of the belt. An electric switch is mounted to the housing and coupled to the electric motor for switching the electric motor on and off. A light bulb is mounted to the housing for illuminating articles hanging on the first hook members, and an automatic lighting system provides electricity to the light bulb for approximately a lamp delay time period in response to the electric switch being switched to an on position.

In another embodiment of the present invention, an apparatus for organizing articles of clothing includes a housing having a cylindrical cavity sized for receiving a closet rod therethrough. First and second drums having first and second axes of rotation, respectively, are rotatably mounted to the housing to permit rotation around the first and second axes. The first and second axes of rotation are positioned substantially parallel to each other. A belt is engaged around the first and second drums. The belt has a plurality of first hook members for hanging articles thereon that extend laterally with respect to the first and second axes of rotation. A clamp for clamping the housing to a closet rod that may be inserted through the cylindrical cavity has a bolt that has its longitudinal axis positioned substantially parallel to the first and second axes so that the bolt is capable of penetrating into the cylindrical cavity. The bolt is countersunk into the housing between the first drum, the second drum, and the belt. An electric motor having an output shaft is mounted to the housing. A pulley and gear system is connected between the output shaft of the electric motor and one of the first and second drums for rotating one of the first and second drums to cause rotation of the belt. An electric switch is mounted to the housing and coupled to the electric motor for switching the electric motor on and off.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

FIG. 9 is a top, bottom, front, side, and cross-sectional view of the battery door of the clothing accessory organizer of FIG. 1.

DETAILED DESCRIPTION OF THE PREFERRED EMBODIMENT

Figure 1:
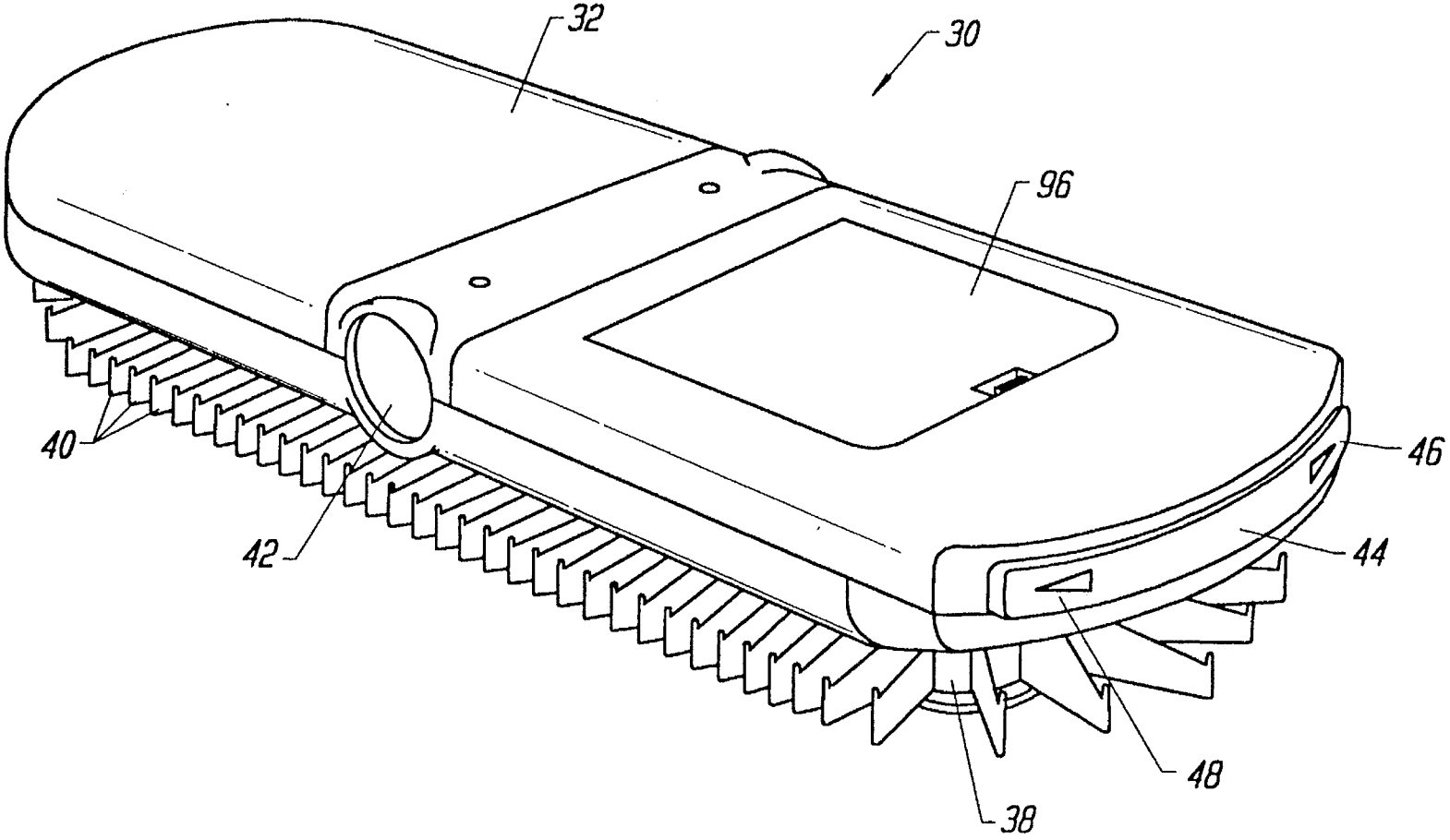
FIG. 1 is an isometric view of a clothing accessory organizer in accordance with the present invention.
Figure 2:
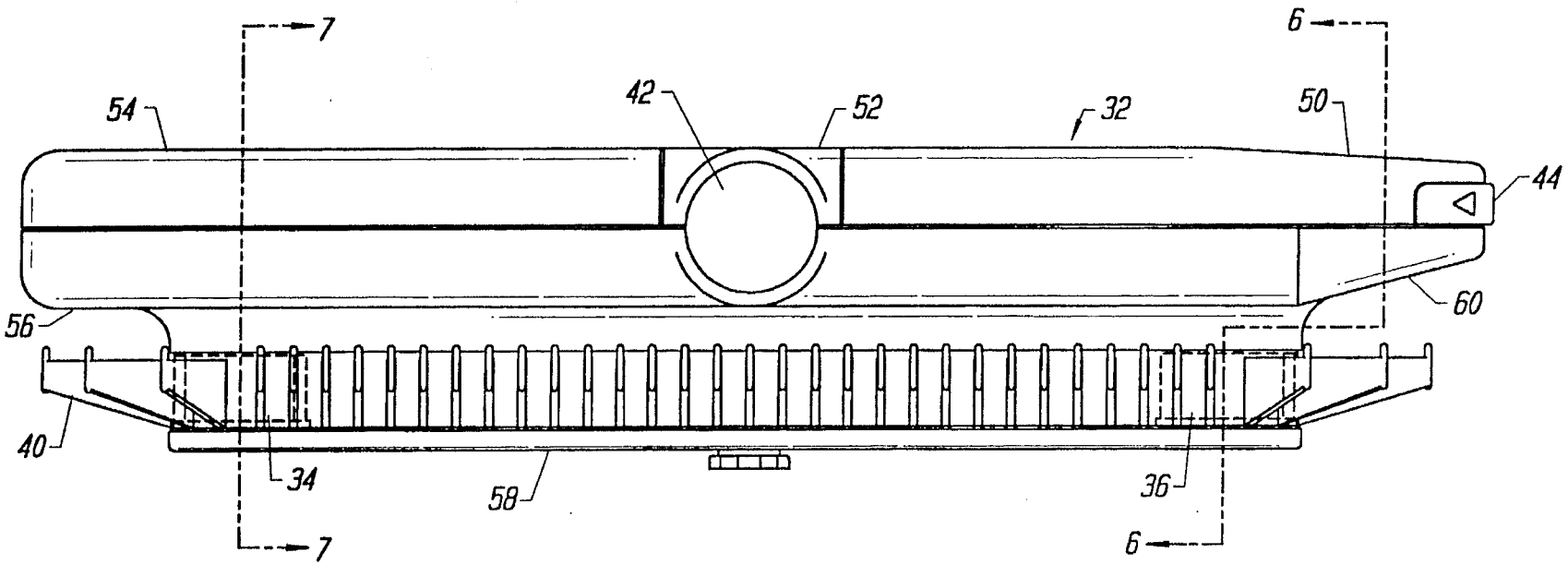
FIG. 2 is a side view of the clothing accessory organizer of FIG. 1.
Figure 3:
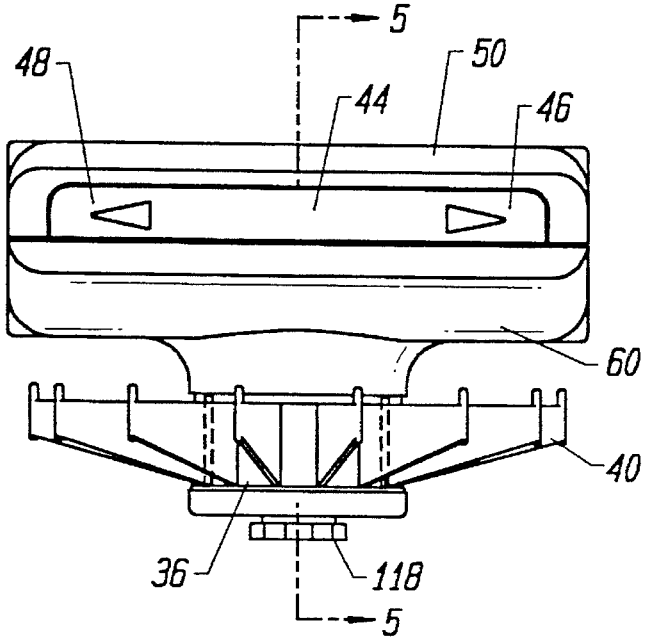
FIG. 3 is a front view of the clothing accessory organizer of FIG. 1.
Figure 4:
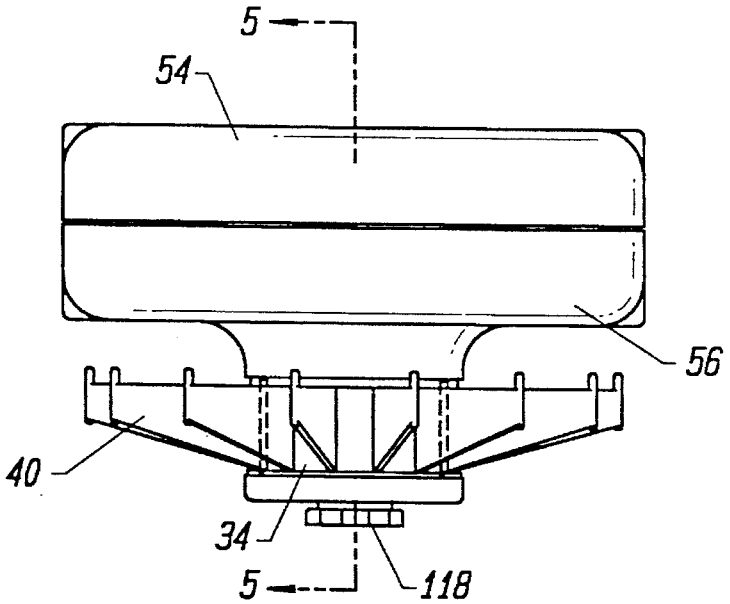
FIG. 4 is a back view of the clothing accessory organizer of FIG. 1.

FIGS. 1 through 4 show a clothing accessory organizer 30 in accordance with the present invention. The organizer 30 is a dynamic device used for the storage, display, and retrieval of clothing accessories, such as neckties, scarves, belts, and other similar articles of clothing. The organizer 30 is may also be used for the storage, display, and retrieval of items of jewelry, such as necklaces. As will be understood from the discussion herein, the organizer 30 overcomes the disadvantages of the static and dynamic devices discussed above by providing an automatic control system for easy location and retrieval of accessories, an automatic lighting system, a more manageable installation system, and a more efficient use of space.

In general, the organizer 30 includes a housing 32, two drums 34 and 36, and a belt 38 wrapped around the drums 34 and 36. The organizer 30 may be mounted inside of a closet to the closet rod or bar (the type on which conventional garment hangers are hanged). The housing 32 has a cavity 42 formed therein for receiving the closet rod. A clamp, which will be discussed below, is used to clamp the housing 32 to the closet rod. The organizer 30 may also be mounted to a wire shelf or a wall, such as a closet wall. The components that are used for mounting the organizer 30 to a wire shelf or wall are not shown in FIGS. 1 through 4 and will be discussed below.

The drums 34 and 36 are rotatably mounted to the housing 32 such that the axes of rotation of each of the drums 34 and 36 are positioned substantially parallel to each other. The belt 38 has several hooks 40 from which articles of clothing can be hung. As will be discussed in more detail below, the hooks 40 are formed integral with the belt 38 so that the hooks 40 and the belt 38 form a single piece of plastic.

Generally, the organizer 30 is utilized by installing it in a convenient location, such as a closet, and hanging articles of clothing on the hooks 40. When the user wishes to locate a specific article, a switch bar 44 on the front of the organizer 30 is depressed on either the right side 46 or the left side 48. When the right side 46 of the switch bar 44 is depressed, the drums 34 and 36 rotate counter-clockwise (as viewed from the top), and when the left side 48 of the switch bar 44 is depressed, the drums 34 and 36 rotate clockwise (as viewed from the top). The rotation of the drums 34 and 36 causes the belt 38 to rotate which moves articles of clothing from the rear of the organizer 30 to the front for easy retrieval.

One of the unique features of the organizer 30 that will be discussed in detail below is an automatic control system. The automatic control system causes the belt 38 to make a little more than one complete rotation when the switch bar 44 is depressed in either direction. The belt 38 automatically stops at the end of the complete rotation. By first making a complete rotation, the user is able to see every article that is on the belt 38 before making a selection. The rotation of the belt 38 stops at any time if the switch bar 44 is depressed in the opposite direction.

The housing 32 includes a top-front section 50, a top-middle section 52, a top-rear section 54, and a mid-section 56. The lower side of the mid-section 56 has a base plate 58. The front of the mid-section 56 has a transparent window 60 formed therein. The housing 32 is preferably formed from ABS plastic, and in the embodiment shown in the figures, the housing 32 is approximately 400 mm long, 125 mm wide, and 85 mm high.

Referring to FIGS. 5 through 8, the drums 34 and 36 are rotatably mounted between the mid-section 56 and the base plate 58. The rear drum 34 has a stud 62 which extends into the mid-section 56, and the base plate 58 has a stud 64 which extends into the rear drum 34. The front drum 36 has a stud 66 which extends into the mid-section 56, and the base plate 58 has a stud 68 which extends into the front drum 36. The studs 62, 64, 66, and 68 provide the pivot points for rotation of the drums 34 and 36.

The rear drum 34 has a main gear 70 attached to the stud 62 via a screw 72. A middle gear 74 drives the main gear 70, and a gear pulley 76 drives the middle gear 74. Standard drive rivets or tubular rivets 77 and 78 provide a controlled bearing surface for securing the middle gear 74 and the gear pulley 76 to the mid-section 56. A motor pulley 80 drives the gear pulley 76 via a motor belt 82. The motor pulley 80 is connected to the output shaft 84 of an electric motor 86. Therefore, the motor 86 drives the rear drum 34 by means of the pulleys and gears 80, 76, 74, and 70. The front drum 36 is driven by the rear drum 34 via the belt 38.

The drums 34 and 36, as well as the pulleys and gears 80, 76, 74, and 70, are preferably made from acetyl or polypropylene. They may be manufactured so that the pivot/friction points have small diameters, such as 6 mm. Lubrication may be used to minimize the vibration of the main gear 70, but the lubrication should be minimized so as not to create a drag on the pulleys and gears 80, 76, 74, and 70.

By way of example, the electric motor 86 may be a model 28S manufactured by SUN Motors of Hong Kong, China. The motor 86 is secured to the mid-section 56 by means of a motor cover 88. In order to minimize the vibration transmitted to the housing 32, the motor 86 is insulated by means of a top motor cushion 90 and a base motor cushion 92. The motor cushions 90 and 92 are formed from a neoprene or similar material isolator.

The motor is preferably powered by four "C" size batteries 94 which are housed beneath the top-front section 50 of the housing 32. While four "C" size batteries are preferred, it should be understood that several different size and quantities of batteries may be used. The top-front section 50 has a battery door 96 therein for gaining access to the batteries 94. FIG. 9 illustrates the battery door 96 in detail.

Referring back to FIGS. 5 through 8, the batteries 94 are electrically coupled to a printed circuit board (PCB) 98 which contains the control electronics for the organizer 30. The PCB 98 has an electric switch 102 and a light bulb 104 mounted thereon and is held in position by a mount 100. In the embodiment shown in Figures, the electric switch has three detented positions, i.e., an off position to turn the motor 86 off, a first on position to turn the motor 86 on so that its output shaft 84 rotates clockwise, and a second on position to turn the motor 86 on so that its output shaft 84 rotates counterclockwise. The electric switch 102 is engaged and switched by the switch bar 44.

FIG. 10 illustrates the switch bar 44 in detail. The switch bar 44 has an arc shape from the left side 48 to the right side 46 in order to conform to the shape of the front of the top-front section 50 of the housing 32. The switch bar 44 is mounted to the mid-section 56 at a pivot point 106. A notch 108 in the rear end of the switch bar 44 engages with the switch 102 to switch it between the three detented positions. The switch bar 44 is preferably made from a transparent or light permeable plastic, such as Styrene Acrylic Nitrile, so that it can be illuminated.

Referring back to FIGS. 5 through 8, the light bulb 104, which is powered by the batteries 94, illuminates the articles of clothing on the hooks 40 as they move past the front of the organizer 30. The light produced by the light bulb 104 shines through the transparent window 60 to facilitate such illumination. Furthermore, the light bulb 104 illuminates the switch bar 44. FIG. 11 illustrates the transparent window 60 in detail. The window 60 may also made from Styrene Acrylic Nitrile.

Referring back to FIGS. 5 through 8, a clamp 110 is used for clamping the housing 32 to a closet rod that may be inserted through the cylindrical cavity 42. The clamp 110 is located on the lower side of the housing 32 so that it is accessible to a user from the lower side of the closet rod. The clamp 110 is easily operated from the lower side of the closet rod because there are no obstructions which make it difficult for a user's hand to grasp the clamp 110. The clamping mechanisms of prior art devices were generally operated from the upper side of the closet rod. This required that a user operate the clamping mechanism in the space between the closet rod and the shelf located just above the closet rod. This space is usually small which made operation of the clamping mechanism difficult.

The clamp 110 includes a bolt 112 that preferably has its longitudinal axis positioned substantially parallel to the axes of rotation of the drums 34 and 36 so that the bolt 112 is capable of penetrating into the cylindrical cavity 42. The bolt 112 is countersunk into the base plate 58 of the housing 32 between the drums 34 and 36 and the belt 38 so that it is hidden from view. A nut 114 engages the threads of the bolt 112. The nut 114 is positioned adjacent to the cylindrical cavity to guide the bolt into the cylindrical cavity. Specifically, the nut 114 is positioned inside the cylindrical cavity 42 and is countersunk into a wall 116 of the cylindrical cavity 42. A bolt cap 118 may be slidably mounted over the bolt 112 for the purpose of allowing a user to easily rotate the bolt 112. The bolt cap 118 is capable of sliding from a position where it extends outside the base plate 58 of the housing 32, so as to be accessible to a user's fingers, to a position where it is substantially countersunk in the base plate 58, so as to be hidden from view.

A lip 115 extends beneath the nut 114. The lip 115 is an extension of the cavity wall 116. The purpose of the lip 115 is to prevent the mid-section 56 of the housing 32 from being pulled apart from the base plate 58 when the bolt 112 is tightened. Specifically, without the lip 115, the nut 114 would rest on the upper part of the base plate 58. As the bolt 112 is tightened, it eventually contacts the closet rod and stops moving up. At this point, the nut 114 moves down the bolt 112 which forces the base plate 58 to pull apart from the mid-section 56. On the other hand, by using the lip 115, as the bolt 112 is tightened, pressure is put on the lip 115 which is itself part of the mid-section 56. Therefore, no force is present which tends to separate the base plate 58 from the mid-section 56.

Figure 12:
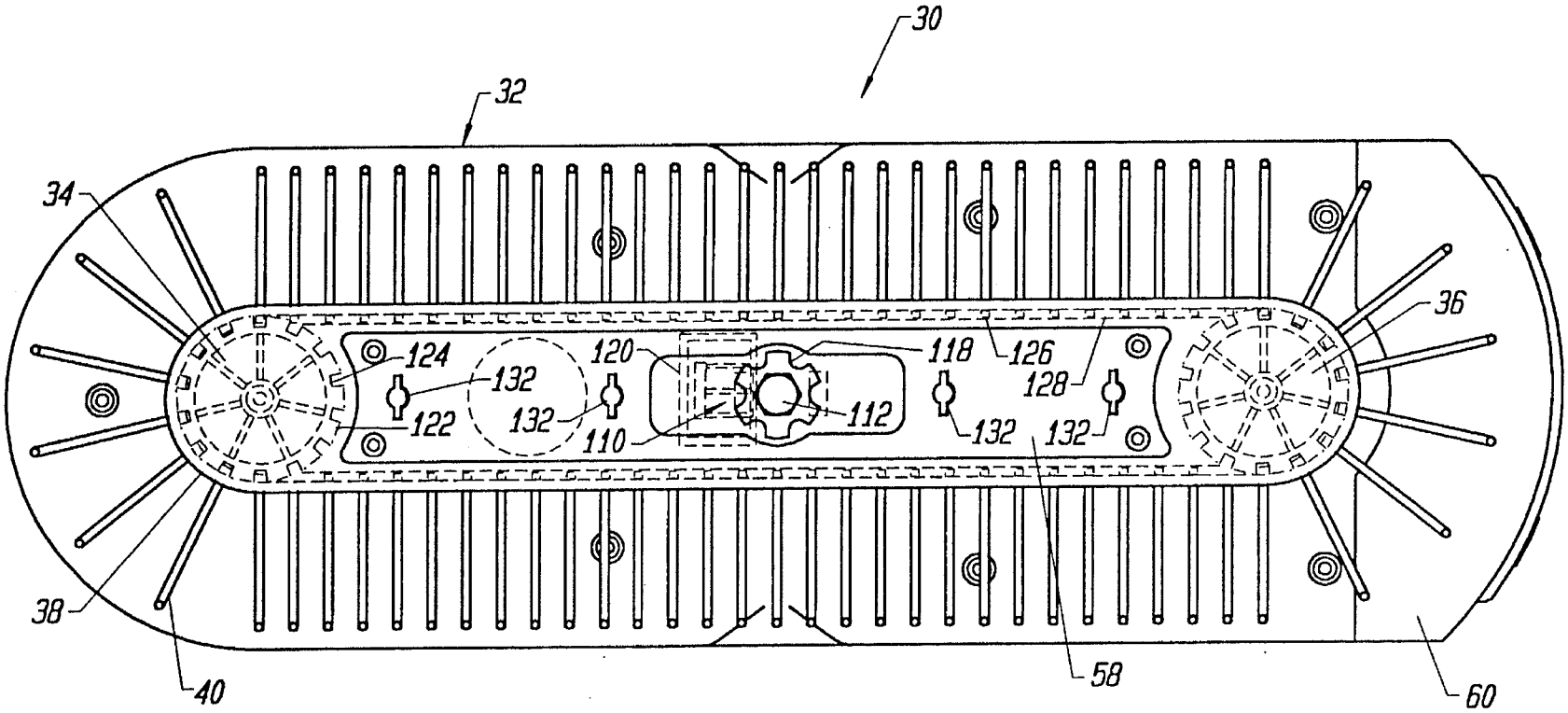
FIG. 12 is a bottom view of the clothing accessory organizer of FIG. 1.
Figure 13D:
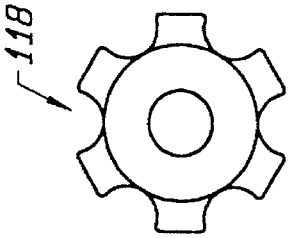
FIG. 13 is a top, bottom, front, side and cross-sectional view of the bolt cap shown in FIGS. 5 and 12.
Figure 13E:
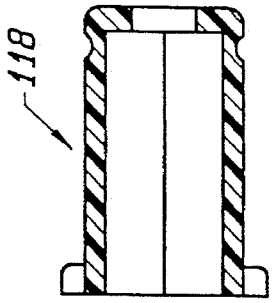
Figure 13C:
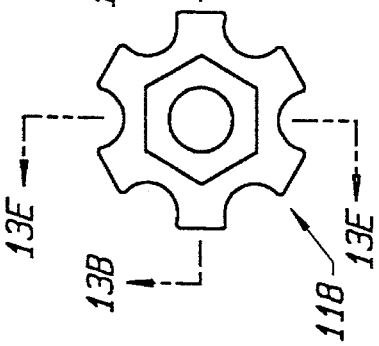
Figure 13B:
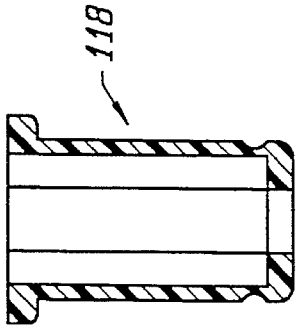
Figure 13A:
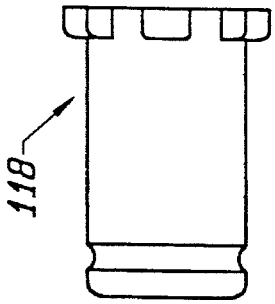

FIG. 12 shows the manner in which the clamp 110 is countersunk into the base plate 58 of the housing 32. A cavity 120 is formed in the base plate 58 for receiving the bolt 112 and the bolt cap 118. During operation, a user inserts his or her fingers into the cavity 120 and slides the bolt cap 118 out of the cavity 120. Once the bolt cap 118 is extended outside of the cavity 120, the user rotates the bolt cap 118 in order to tighten the bolt 112 against a closet rod. When the bolt 112 is tight, the user slides the bolt cap 118 back into the cavity 120 so that it is hidden from view. FIG. 13 illustrates the bolt cap 118 in detail. The bolt cap 118 is preferably made from ABS plastic.

Referring back to FIG. 12, the drums 34 and 36 are preferably sprocket-like members having teeth 122 and notches 124 for engaging complimentary teeth 126 and notches 128 on the inside of the belt 38. The teeth 122 and 126 and notches 124 and 128 prevent the belt 38 from slipping on the drums 34 and 36.

Figure 14B:
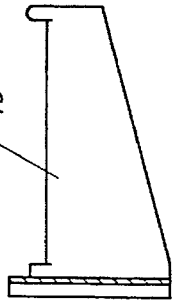
FIG. 14B is cross-sectional view of one of the hooks of the belt.
Figure 14A:
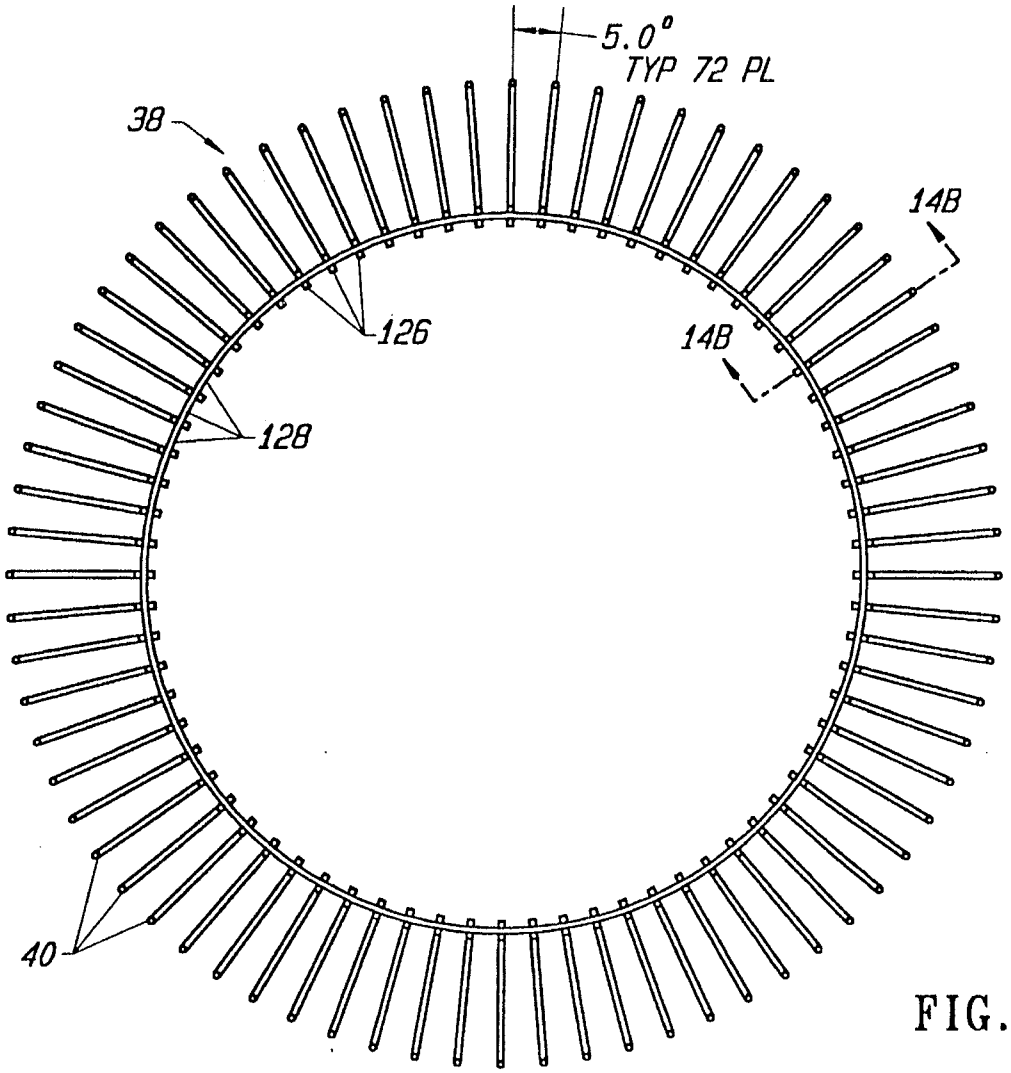
FIG. 14A is a top plan view of the belt of the clothing accessory organizer of FIG. 1.
Figure 15F:
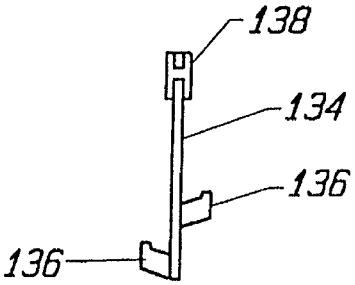
FIG. 15 is a top, bottom, front, side and cross-sectional view of the stationary hook shown in FIG. 5.
Figure 15C:
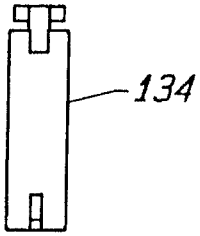
Figure 15B:
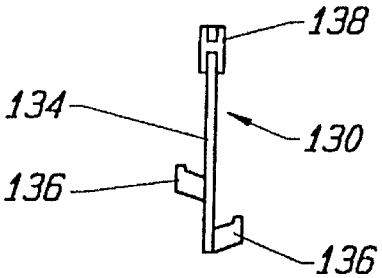
Figure 15D:
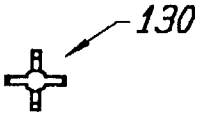
Figure 15A:
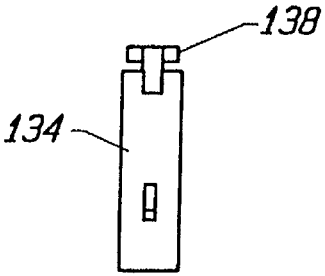
Figure 15E:
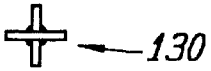

FIGS. 14A and 14B illustrate the belt 38 and hooks 40 in detail. The belt 38 is preferably formed from polypropylene in order to make it flexible so that less power is required to drive it. Alternatively, the belt 38 may be formed from a propylene-ethylene blend, As mentioned above, the hooks 40 are preferably formed integral with the belt 38 so that the belt 38 and hooks 40 form a single piece of polypropylene. Although the belt 38 may contain many different numbers of hooks 40, it has been found that seventy-two hooks provides sufficient storage space for most users' clothing accessories while leaving enough space between the individual hooks 40 for easy placement and retrieval of the accessories. When it is formed into a circle, the belt 38 preferably has a diameter of 206.24 mm and the hooks 40 are each separated by 5°.

A standard molding machine may be used to form the belt 38. The belt 38 is made more durable and less susceptible to cracking by exercising it to align the crystalline structure in the plastic. The exercising step is performed while the belt 38 is still cooling after it is removed from the molding machine. Specifically, the exercising step is performed by spinning the belt 38 around two pulleys having diameters smaller than the diameters of the drums 34 and 36. After the belt 38 is exercised, it is stacked with many other belts on a large cylinder to keep it round and flat while it cools.

Figure 5:
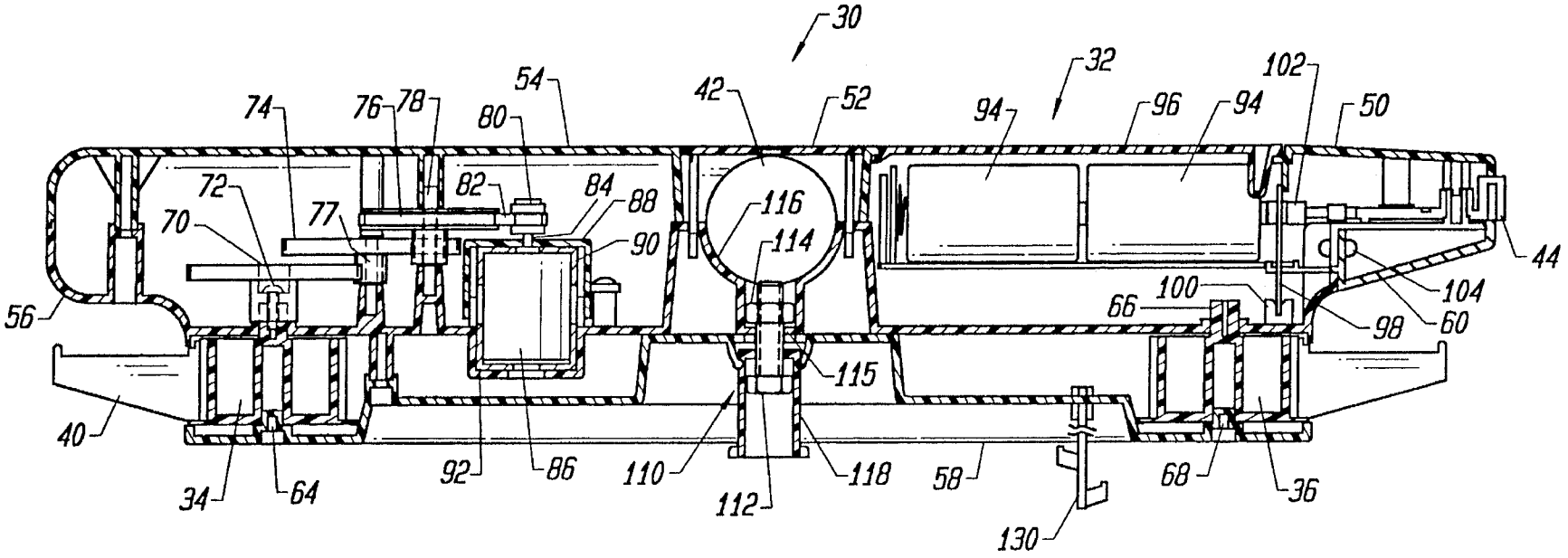
FIG. 5 is a cross-sectional side view taken along lines 5—5 of FIGS. 3 and 4.
Figure 6:
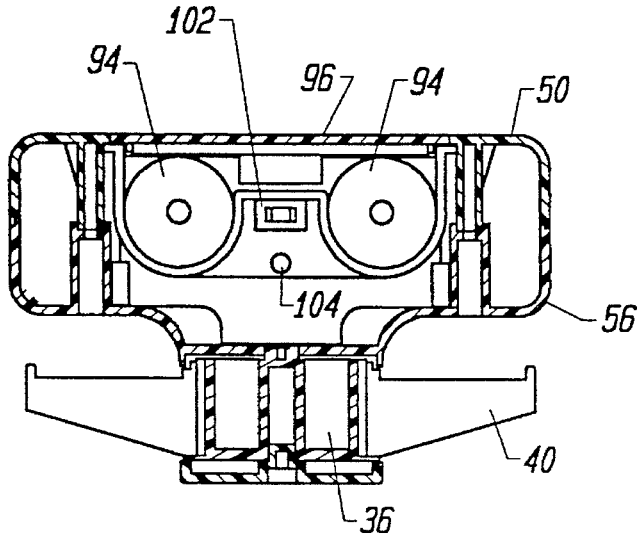
FIG. 6 is a cross-sectional front view taken along line 6—6 of FIG. 2.
Figure 7:
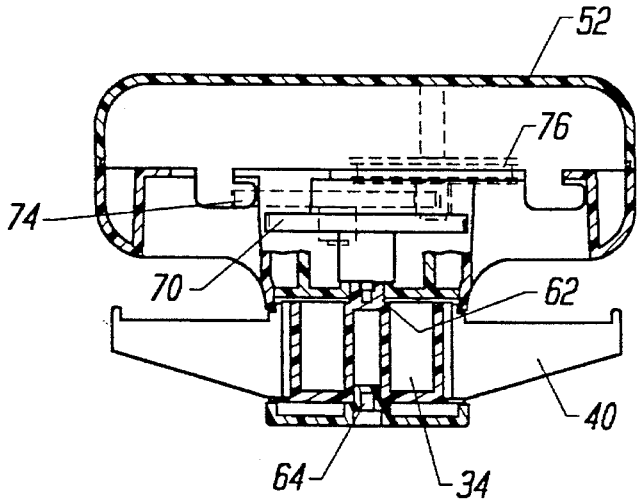
FIG. 7 is a cross-sectional back view taken along line 7—7 of FIG. 2, with the addition of two wire shelf brackets.
Figure 8:
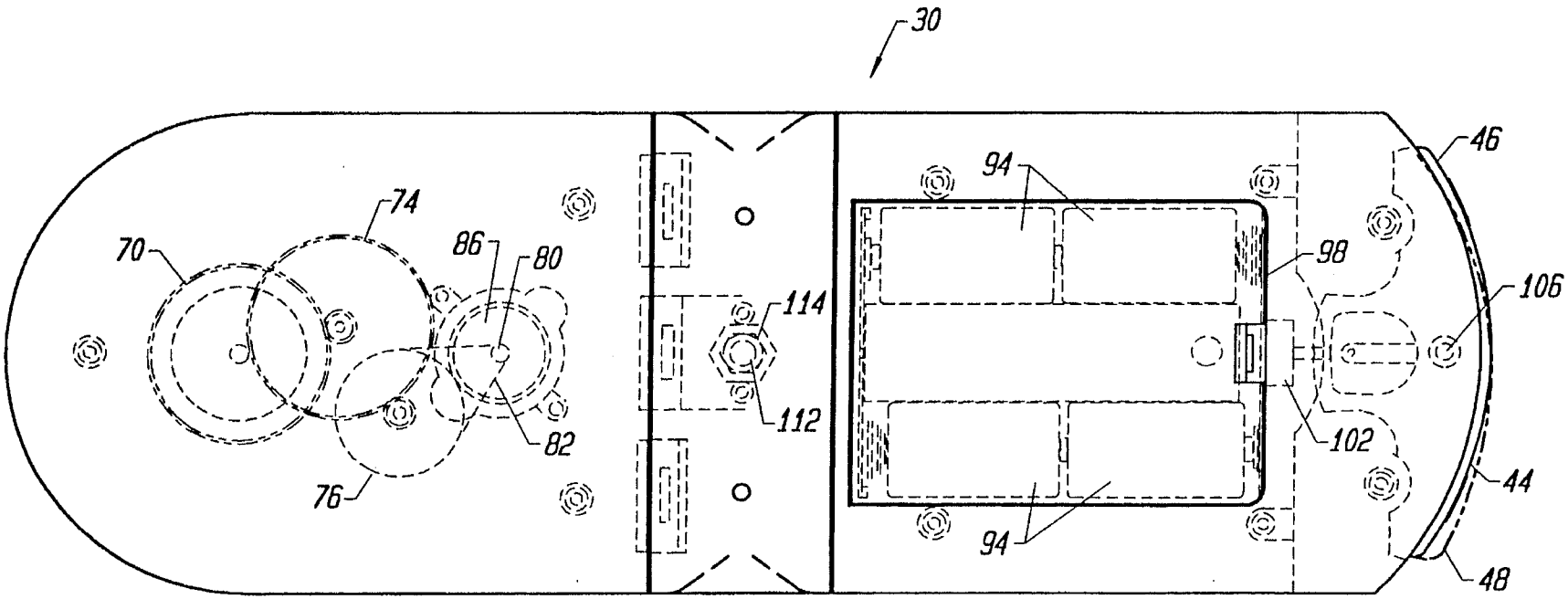
FIG. 8 is a top plan view of the clothing accessory organizer of FIG. 1.
Figure 10B:
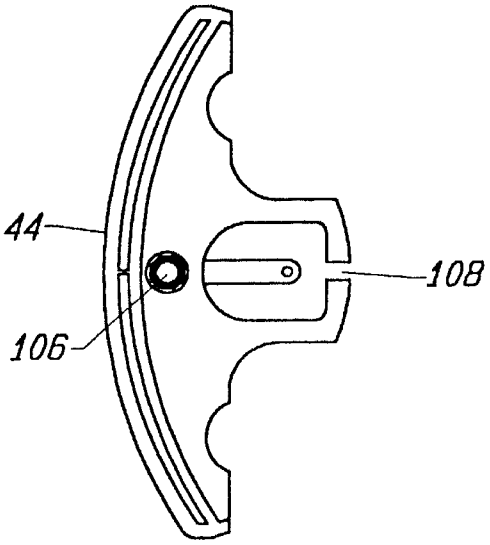
FIG. 10 is a top, bottom, front, side and cross-sectional view of the switch bar of the clothing accessory organizer of FIG. 1.
Figure 10C:
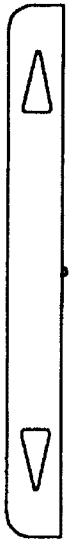
Figure 10D:
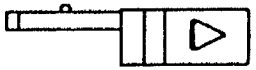
Figure 10A:
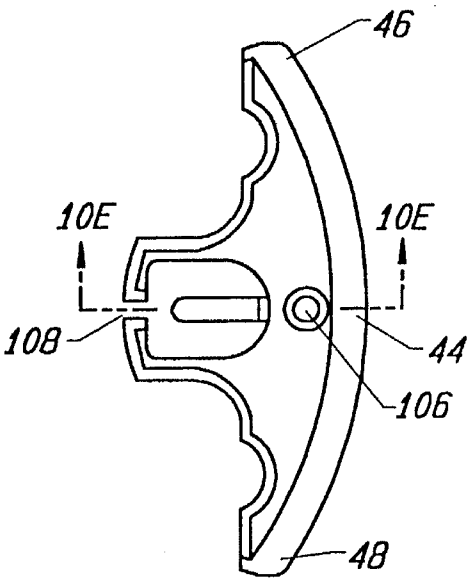
Figure 10E:
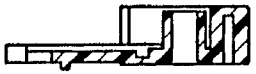
Figure 11B:
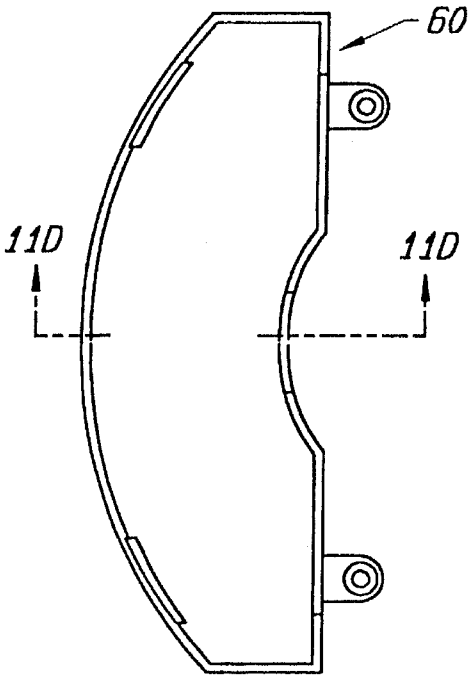
FIG. 11 is a top, bottom, front, side and cross-sectional view of the transparent window of the clothing accessory organizer of FIG. 1.
Figure 11C:
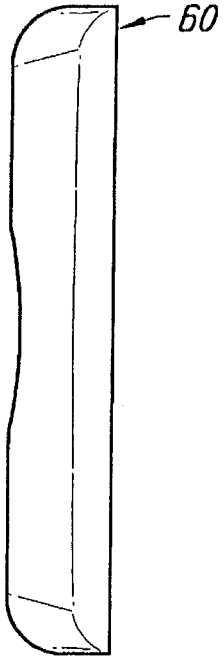
Figure 11D:
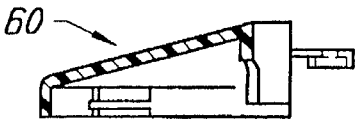
Figure 11A:
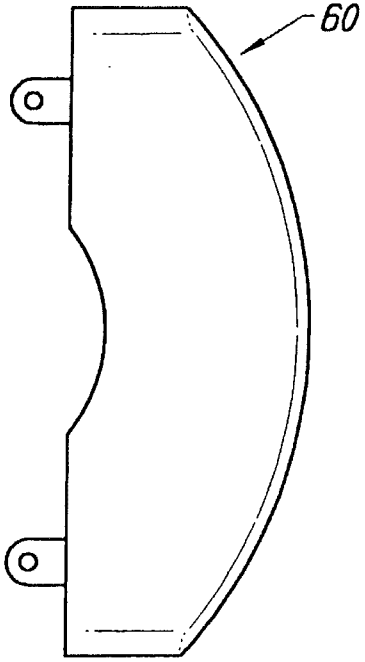
Figure 11E:
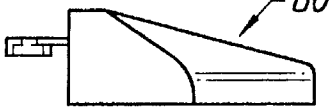
Figure 11F:
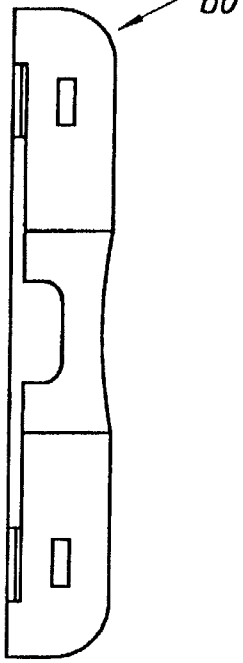

Referring to FIGS. 5 and 12, several stationary hooks 130 may be mounted to the base plate 58 for the storage of less flexible clothing accessories, such as belts. Although many different numbers of the stationary hooks 130 may be mounted to the base plate 58, four stationary hooks 130 mounted in holes 132 has been found to provide sufficient storage space and easy placement and retrieval of clothing accessories.

FIG. 15 illustrates one of the stationary hooks 130 in detail. The stationary hook 130 is a double sided hook that includes an elongate member 134 with two laterally extending members 136. A T-shaped mounting member 138 at the top of the elongate member 134 is designed to be inserted into the holes 132 and then twisted to be secured therein. The stationary hooks 130 are preferably made from ABS plastic.

Many closets are not equipped with a conventional closet rod or bar of the type that may be inserted into the cavity 42. Instead, these closets are often equipped with wire shelves, Referring to FIG. 20, the organizer 180 may be mounted to a wire shelf via two wire shelf brackets 140. The two wire shelf brackets 140 (only one can be seen) each include an elongate bolt 142 having one end inserted into the top-middle section 52 of the housing 32 such that the bolts 142 penetrate the cylindrical cavity 42. A nut 148, such as a conventional wing nut, and a washer 150, may be used to secure the elongate bolts 142 into the top-middle section 52. The other end 144 of the elongate bolts 142 have a hook shape for engaging the wire shelf 146. A washer-type member 152 having a channel 153 therein engages the lower portion of the wire shelf 146 to prevent the organizer 180 from slipping off of the wire shelf 146.

Figure 16A:
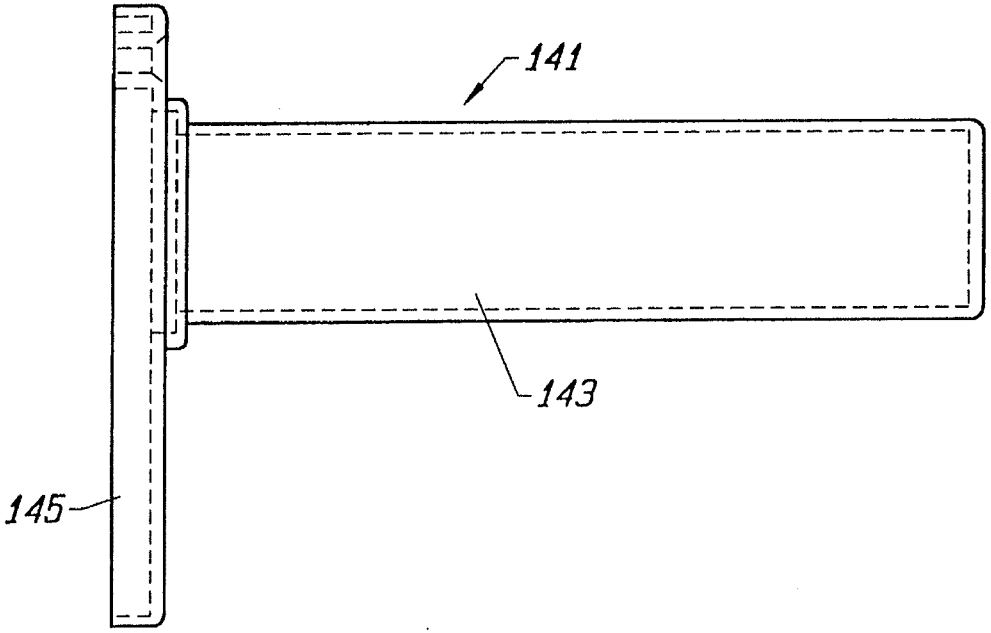
FIG. 16 is a top and side view of a wall mount bracket that may be used with the clothing accessory organizer of FIG. 1.
Figure 16B:
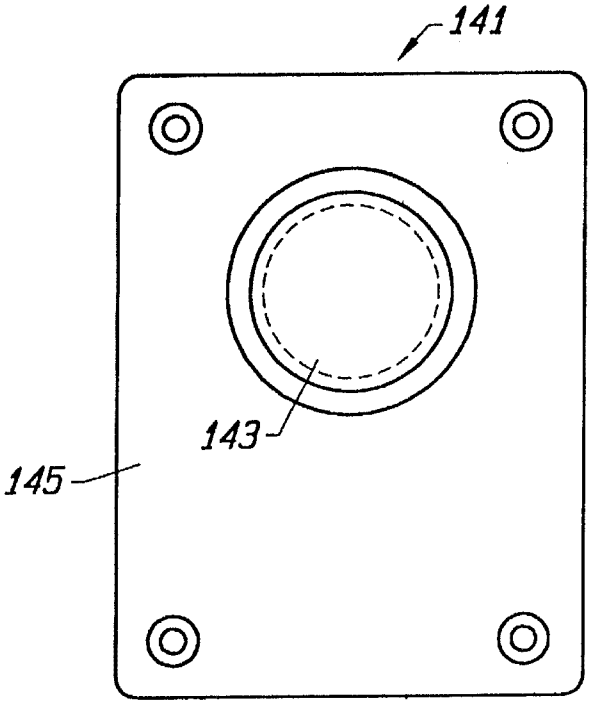

The organizer 30 may also be mounted to a wall. FIG. 16 illustrates a wall mount bracket 141 for mounting the housing 32 to a wall. The wall mount bracket 141 includes a cylindrical rod 143 that protrudes from a base 145. The cylindrical rod 143 has a diameter that is approximately the same size as a standard closet rod. The base 145 is attached to a wall by means of screws, or the like, and the cylindrical rod 143 is inserted into the cylindrical cavity 42 to support the organizer 30. The organizer 30 is clamped to the cylindrical rod 143 in the same manner that it is clamped to a standard closet rod.

Figure 17:
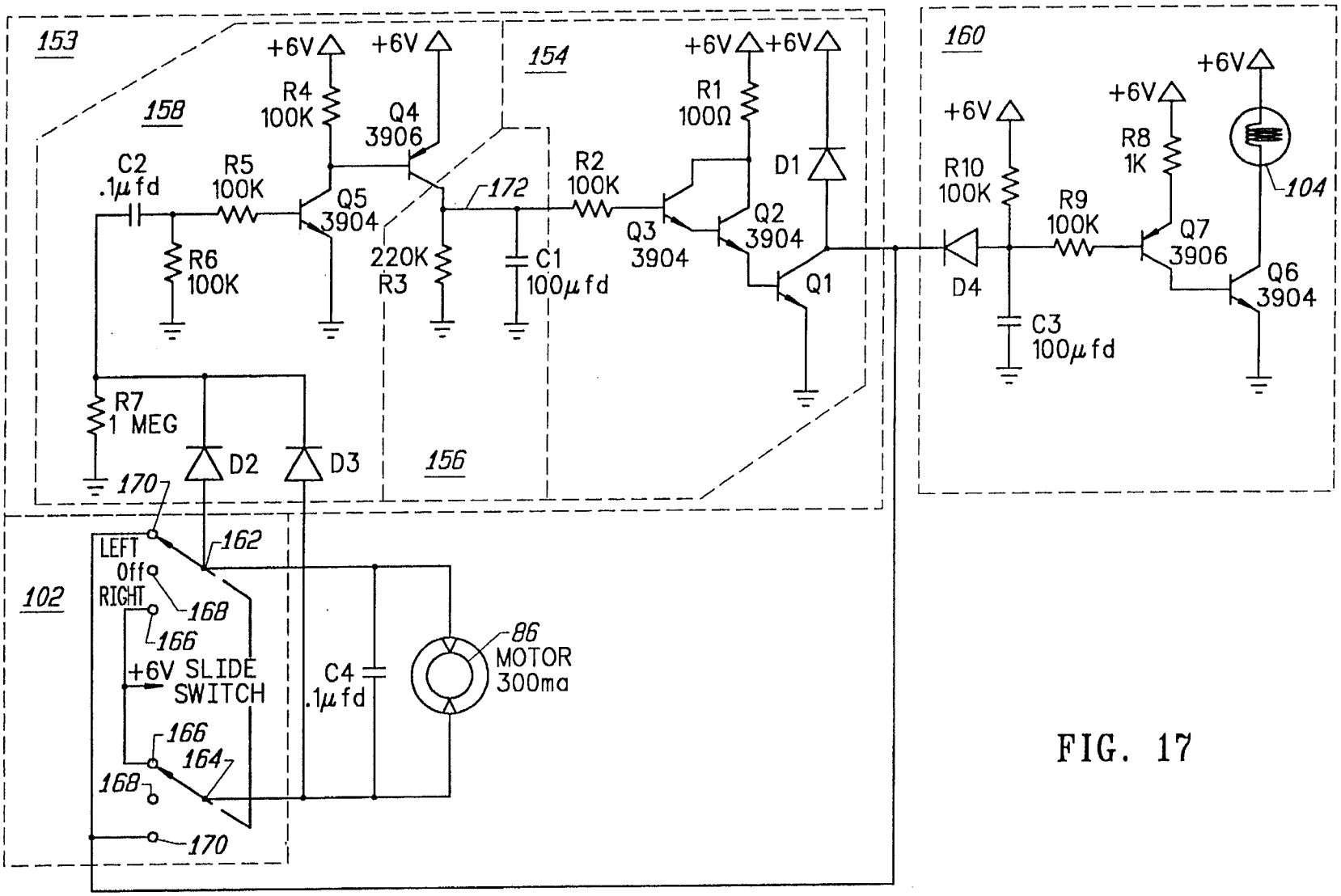
FIG. 17 is a schematic diagram of an electrical implementation of an automatic control system that may be used in the clothing accessory organizer of FIG. 1.

FIG. 17 is a schematic diagram of one embodiment of the control electronics that may be contained on the PCB 98. The control electronics embodies an electrical implementation of the automatic control system mentioned above that causes the belt 38 to automatically make a little more than one complete rotation. Other embodiments of the automatic control system, including another electrical implementation and a mechanical implementation, are described below.

The control electronics generally includes the three position switch 102, motor delay circuitry 153, and lamp circuitry 160. The three position switch 102 switches each of the two inputs 162 and 164 of the electric motor 86 between three contacts 166, 168, and 170. The switch contact 166 is connected to the four series connected C size batteries 94 which creates a 6 Volt potential; the switch contact 168 is unconnected; and, the switch contact 170 is connected to the grounding circuitry 154 and the lamp circuitry 160. The switch 102 is controlled by the switch bar 44.

When the switch 102 is in the off position, both of the motor inputs 162 and 164 are connected to the switch contact 168. Because the switch contact 168 is unconnected, no power is supplied to the motor 86. When the switch 102 is switched to the first on position, the motor input 162 is connected to the switch contact 170 and the motor input 164 is connected to the switch contact 166. As will be explained below, the motor delay circuitry 153 couples the switch contact 170 to ground for a motor delay time period. Therefore, in the first on position, the motor input 162 will be coupled to ground for the motor delay time period and the motor input 164 will be coupled to 6 Volts. These connections cause the motor output shaft 84 to rotate in one direction. When the switch 102 is switched to the second on position, the motor input 162 is connected to the switch contact 166 and the motor input 164 is connected to the switch contact 170. Therefore, in the second on position, the motor input 162 will be coupled to 6 Volts and the motor input 164 will be coupled to ground for the motor delay time period. These connections cause the motor output shaft 84 to rotate in the other direction.

The automatic control system operates as follows. When the switch 102 is switched to and retained in one of the on positions, the motor delay circuitry 153 couples the switch contact 170 to ground for a period of time approximately equal to a motor delay time period. At the end of the motor delay time period, the motor delay circuitry 153 uncouples the switch contact 170 from ground even though the switch 102 remains in one of the on positions. Because the switch contact 170 is uncoupled from ground, power is removed from the motor 86 at the end of the motor delay time period. If a user switches the switch 102 to one of the on positions but then desires to stop rotation of the belt 38 before the end of the motor delay time period, the user simply switches the switch 102 to the off position which removes power from the motor 86 immediately.

As will be explained below, the length of the motor delay time period may be adjusted to suit a user's particular needs by adjusting the value of a capacitor C1 and a resistor R3. However, it has been found that a particularly advantageous motor delay time period length is a length of time such that the belt 38 makes a little more than one complete rotation around the drums 34 and 36. When using the type of motor 86 mentioned above, this length of time is approximately equal to twenty seconds. By causing the belt 38 to make one complete rotation, the user is able to see every article that is on the belt before making a selection.

The motor delay circuitry 153 includes grounding circuitry 154, an R-C circuit 156, and charging circuitry 158. In general, when the switch 102 is switched to one of the on positions, the charging circuitry 158 charges a capacitor C1 in the R-C circuit 156. The R-C circuit 156 then provides a current that is used to switch a transistor Q1 in the grounding circuitry 154 into a conducting state. The R-C circuit 156 provides enough current to the transistor Q1 such that it remains in the conducting state for a length of time approximately equal to the motor delay time period. While the transistor Q1 is in the conducting state, the switch contacts 170 are coupled to ground.

The grounding circuitry 154 includes an npn transistor Q1 having its collector coupled through a diode D1 to the 6 Volt supply and its emitter connected to ground. The diode D1 protects the transistor Q1 from inductive kick. The collector of the transistor Q1 is also connected to the switch contacts 170. The base of the transistor Q1 is connected to the emitter of an npn transistor Q2 which forms a Darlington pair with another npn transistor Q3. The collectors of the transistors Q2 and Q3 are coupled through a 100 Ω resistor R1 to the 6 Volt supply. The base of the transistor Q3 is coupled through a 100K Ω resistor R2 to the R-C circuit 156.

The R-C circuit 156 includes a 220K Ω timing resistor R3 and a 100 μF capacitor C1 that are connected in parallel between ground and a node 172 that is common with one terminal of the resistor R2. The node 172 is connected to the charging circuitry 158. As will be discussed below, the values of the timing resistor R3 and the capacitor C1 determine the length of the motor delay time period; therefore, it should be understood that their values may be adjusted to achieve a desired length of the motor delay time period.

The charging circuitry 158 includes a pnp transistor Q4 having its emitter connected to the 6 Volt supply and its collector connected to the node 172. The base of the transistor Q4 is connected to the collector of an npn transistor Q5 that has its emitter grounded. The collector of the transistor Q5 is coupled through a 100K Ω resistor R4 to the 6 Volt supply. The base of the transistor Q5 is coupled through a 100K Ω resistor R5 to a 0.1 μF capacitor C2 and a 100K Ω resistor R6. The other terminal of the resistor R6 is connected to ground, and the other terminal of the capacitor C2 is connected to the cathodes of two diodes D2 and D3 and through a 1M Ω resistor R7 to ground. The anodes of the diodes D2 and D3 are connected to the motor 86 inputs 162 and 164, respectively.

During operation, when the switch 102 is switched to one of the on positions, the anode of one of the diodes D2 or D3 is connected to the 6 Volt supply via the motor inputs 162 or 164, respectively. The voltage at the capacitor C2 rises which causes it to pass a current spike to the base of the transistor Q5. The transistor Q5 is briefly switched into the conducting state which causes the base of the transistor Q4 to be pulled down. The transistor Q4 then conducts current which charges the capacitor C1. When the voltage at the capacitor C2 reaches steady state, no more current flows to the base of the transistor Q5 which switches both of the transistors Q5 and Q4 off.

The capacitor C1 then begins to discharge according to the time constant produced by the timing resistor R3 and the capacitor C1. The capacitor C1 provides current to the base of the Darlington transistor pair Q3 and Q2 which amplifies the current and provides it to the base of the transistor Q1. The transistor Q1 is switched into the conducting state which couples the switch contact 170 to ground. The capacitor C1 discharges and provides the current that is used to switch transistor Q1 into a conducting state for a period of time approximately equal to the motor delay time period. Therefore, the motor delay time period can be adjusted by adjusting the values, and thus, the time constant, of the capacitor C1 and the timing resistor R3. When the capacitor C1 is discharged down to approximately three base-emitter junction voltages, i.e., approximately 1.8 Volts, the transistor Q1 is switched into a nonconductive state which removes ground, and thus, power, from the motor 86.

In order to reset the motor delay circuitry 153, the capacitor C2 should be fully discharged so that it can pass another current spike to the base of transistor Q5 when the switch 102 is again switched to one of the on positions 166 or 170. A 1M Ω resistor R7 is used to discharge the capacitor C2 when the switch 102 is switched to the off position 168.

When the switch 102 is switched to one of the on positions, the lamp circuitry 160 causes the light bulb 104 to be illuminated for a length of time approximately equal to the motor delay time period. Even if the switch 102 is switched to the off position in order to stop the motor 86 before the end of the motor delay time period, the light bulb 104 will remain illuminated for the remainder of the motor delay time period.

Specifically, the lamp circuitry 160 includes an npn transistor Q6 having its collector coupled through the light bulb 104 to the 6 Volt supply and its emitter connected to ground. The light bulb 104 may be connected to the circuit by using a socket and screwing the light bulb 104 in the socket with lock tight, or, the wire leads of the light bulb 104 may be soldered directly to the PCB 98 without a socket. This direct connection of the light bulb 104 eliminates the bulb from vibrating loose during use. The base of the transistor Q6 is connected to the collector of a pnp transistor Q7 having its emitter coupled through a 1K Ω resistor R8 to the 6 Volt supply. The base of the transistor Q7 is coupled through a 100K Ω resistor R9 to a 100 μF capacitor C3, the anode of a diode D4, and a 100K Ω resistor R10. The other terminal of the capacitor C3 is connected to ground, and the other terminal of the resistor R10 is connected to the 6 Volt supply. The cathode of the diode D4 is connected to the switch 102 contacts 170.

Before the switch 102 is switched to one of the on positions, the transistor Q1 is not in a conducting state. The cathode of the diode D4 is pulled high which causes no current to be conducted thereby. The capacitor C3 is charged via the 6 Volt supply, and it remains fully charged while the switch 102 remains in the off position. Because the capacitor C3 is fully charged, the base of the transistor Q7 is pulled high which prevents it from switching into a conducting state. Because the transistor Q7 is not conducting current, the transistor Q6 is likewise not conducting current, and the light bulb 104 remains off.

When the switch 102 is switched to one of the on positions, the transistor Q1 is switched into a conducting state for the entire motor delay time period, regardless of whether the switch 102 is thereafter switched to the off position. The transistor Q1 provides a discharge path for the capacitor C3. As the capacitor C3 is discharged, the base of the transistor Q7 is pulled down which switches it into a conducting state. The transistor Q7 provides current to the base of the transistor Q6 which switches it into a conducting state as well. The transistor Q6 couples the light bulb 104 to ground which causes it to illuminate. Therefore, the transistor Q1 indirectly switches the transistor Q6 into a conducting state.

At the end of the motor delay time period, the transistor Q1 stops conducting current which allows the capacitor C3 to charge. As the capacitor C3 charges, the base of the transistor Q7 is pulled up which switches both of the transistors Q7 and Q6 and the light bulb 104 off.

In the circuitry shown in FIG. 17, the light bulb 104 remained illuminated for the motor delay time period. It is envisioned, however, that the circuitry could be modified to provide that the light bulb 104 remain illuminated for a different, separate, and independent time period, such as a lamp delay time period. Specifically, a second delay circuit, similar to the motor delay circuitry 153, could be added which controls only the lamp circuitry 160. In this scenario, the motor 86 and the light bulb 104 would be controlled by separate delay circuits, and therefore, they could have separate delay times. The lamp delay time period could, of course, be equal to the motor delay time period.

The transistor Q1 is preferably a TIP29, 1 amp, npn transistor. The transistors Q2, Q3, Q5, and Q6 are preferably 2N3904 npn transistors. The transistors Q4 and Q7 are preferably 2N3906 pnp transistors.

Figure 18:
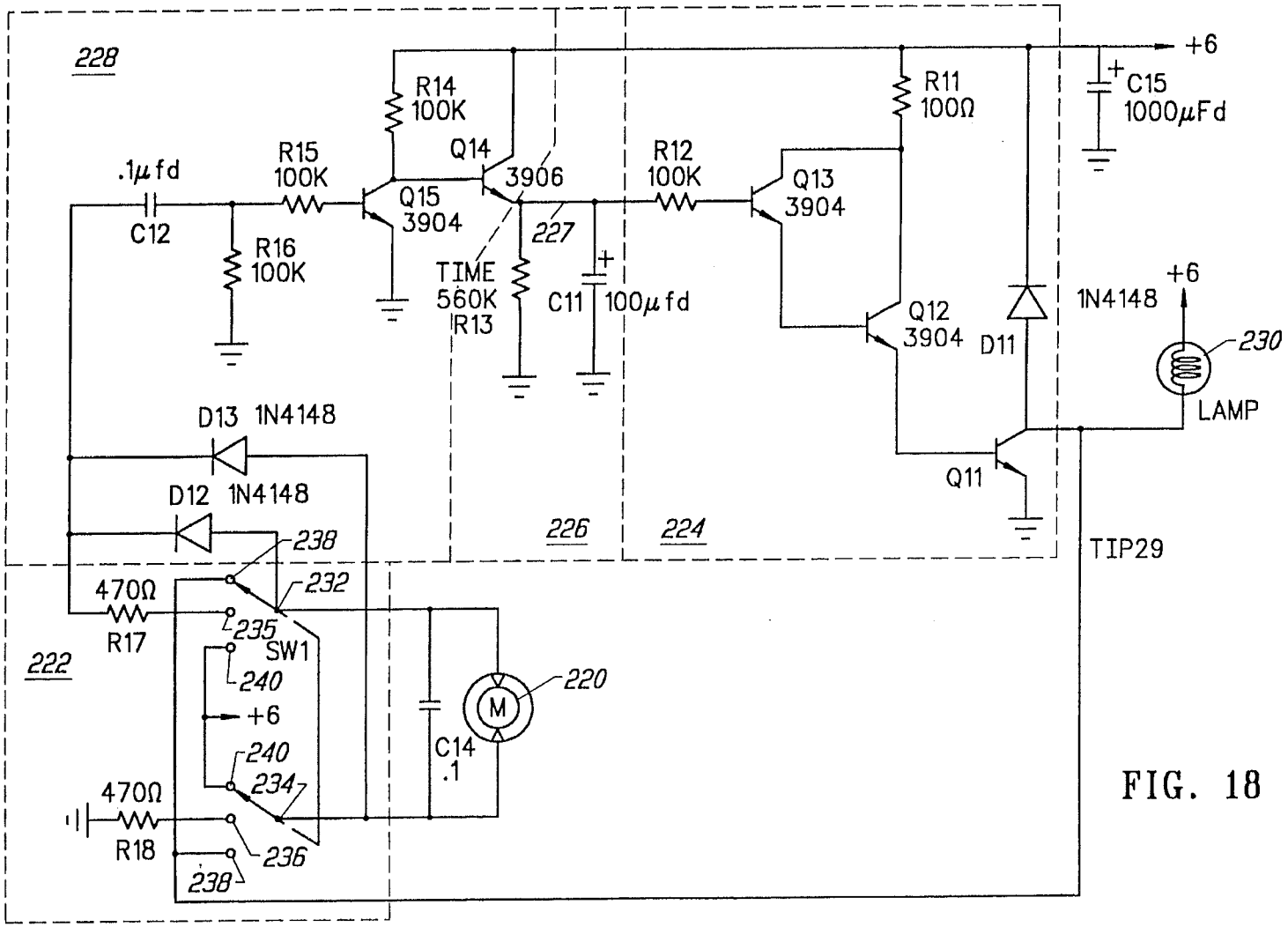
FIG. 18 is a schematic diagram of another embodiment of an electrical implementation of an automatic control system that may be used in the clothing accessory organizer of FIG. 1.

FIG. 18 is a schematic diagram of another embodiment of the control electronics that may be contained on the PCB 98. The embodiment of the control electronics shown in FIG. 18 is similar to the embodiment shown in FIG. 17 in that the motor 220 is connected to a 6 Volt supply and grounded for a motor delay time period by a three position switch 222 and grounding circuitry 224. An R-C circuit 226 and a charging circuit 228 control the grounding circuitry 224. However, unlike the embodiment shown in FIG. 17, the embodiment shown in FIG. 18 does not include separate lamp circuitry, such as the lamp circuitry 160. Instead, the lamp 230 is grounded directly by the grounding circuitry 224.

The three position switch 222 switches the two motor contacts 232 and 234 between an off position and two on positions. When the switch 222 is in the off position, both motor contacts 232 and 234 are connected to contacts 235 and 236, respectively. As will be discussed below, two resistors R17 and R18 are connected to the contacts 235 and 236, respectively, to provide a discharge path through the motor 220 to ground for the charging circuit 228. When the switch 222 is in either on position, the contact 238 provides ground for the motor 220 (for the motor delay time period) and the contact 240 provides 6 Volts to the motor 220.

The grounding circuitry 224, which is identical to the grounding circuitry 154, includes an npn transistor Q11 for coupling the contact 238 to ground. A 100K Ω resistor R12 and a Darlington connected pair of npn transistors Q12 and Q13 provide current to the base of the transistor Q11. The collectors of the transistors Q12 and Q13 are coupled to the 6 Volt supply through a 100 Ω resistor R11. The collector of the transistor Q11 is coupled to the 6 Volt supply through a diode D11. The diode D11 protects the transistor Q11 from inductive kick.

The R-C circuit 226 is identical to the R-C circuit 156. Specifically, the R-C circuit 226 includes a 560K Ω timing resistor R13 and a 100 μF timing capacitor C11 that are connected in parallel between ground and a node 227 that is common with one terminal of the resistor R12. The node 227 is connected to the charging circuitry 228. The timing capacitor C11 provides current to the Darlington pair of transistors Q12 and Q13 in order to switch the transistor Q11 into a conducting state. As discussed above, it should be understood that the values of the timing resistor R13 and the capacitor C11 may be adjusted to achieve the desired length of the motor delay time period. For example, a value of 560K Ω for the resistor R13 provides a motor delay time period that causes the belt 38 to make a little more than one complete rotation when it is fully loaded and fresh batteries are used. On the other hand, a value of 220K Ω for the resistor R13 provides a motor delay time period that causes the belt 38 to make a little more than one complete rotation when it is partially loaded and fresh batteries are used.

The charging circuit 228 is very similar to the charging circuit 158. Specifically, the charging circuitry 228 includes a pnp transistor Q14 having its emitter connected to the 6 Volt supply and its collector connected to the node 227. The base of the transistor Q14 is connected to the collector of an npn transistor Q15 that has its emitter grounded. The collector of the transistor Q15 is coupled through a 100K Ω resistor R14 to the 6 Volt supply. The base of the transistor Q15 is coupled through a 100K Ω resistor R15 to a 0.1 μF capacitor C12 and a 100K Ω resistor R16. The other terminal of the resistor R16 is connected to ground, and the other terminal of the capacitor C12 is connected to the cathodes of two diodes D12 and D13. The anodes of the diodes D12 and D13 are connected to the motor 220 contacts 232 and 234, respectively.

Unlike the charging circuitry 158, however, the capacitor C12 of the charging circuitry 228 is connected to a 470 Ω resistor R17 which is connected to the switch contact 235. The other switch contact 236 is connected to a 470 Ω resistor R18 which is connected to ground. The resistors R17 and R18 provide a discharge path for the capacitor C12 and replace the 1M Ω resistor R7 in the charging circuit 158.

When the switch 222 is in the off position, the capacitor C12 is discharged through the resistor R17, through the motor 220 (which is about 1K Ω), and through the resistor R18 to ground. There are two advantages of using the resistors R17 and R18 rather than the 1M Ω resistor R7 as in the charging circuit 158. First, the capacitor C12 discharges much faster through resistors R17 and R18 than through resistor R7. Fast discharge is important because for the timing capacitor C11 to fully charge the next time that the switch 222 is switched to one of the on positions, the capacitor C12 should first be fully discharged. The capacitor C12 will only discharge if the switch 222 is switched to the off position. If, after the motor delay time period, the switch 222 is switched fairly quickly from one on position to the other on position, the switch 222 is in the off position only for a short time. During the short time that the switch 222 is in the off position, the capacitor C12 must discharge. Using the 1M Ω resistor R7, the switch 102 must be left in the off position for approximately .5 seconds for C2 to fully discharge. However, the resistors R17 and R18 speed up discharge by 1000 to 1. Therefore, the switch 222 needs to be in the off position for a much shorter period of time for the capacitor C12 to fully discharge.

The second advantage of using the resistors R17 and R18 is that, with the 1M Ω resistor R7, if the switch 102 is left in one of the on positions after the motor delay time period has expired, the 6 Volt supply terminal 166 is connected through one of the diodes D2 and D3 to the resistor R7 which is grounded. Although small, there is a constant drain on the batteries. On the other hand, by using the resistors R17 and R18, the 6 Volt supply terminal 240 does not have a direct path to ground, which extends the life of the batteries. The only quiescent current in the circuit shown in FIG. 18 is leakage in the capacitor C15 (the capacitor C15 is discussed below).

The light bulb 230 is connected directly to the collector of the transistor Q11. Thus, the light bulb 230 is grounded and illuminates for the same period of time that the motor 220 runs. In other words, if the motor 220 is left running for the full motor delay time period, the light bulb 230 will dim out as the motor 220 slows to a stop at the end of the motor delay time period.

If the switch 222 is switched to the off position before the motor delay time period expires, the light bulb 230 will remain on because the transistor Q11 is still in a conducting mode. Furthermore, the light bulb 230 will become slightly brighter and the motor delay time period will become slightly longer. The light bulb 230 becomes slightly brighter because when the motor 220 is disconnected the supply voltage increases. The motor delay time period becomes slightly longer because the load on the timing capacitor C11 is decreased which extends the remaining delay time.

A 1000 μF capacitor C15 is coupled between the 6 Volt supply and ground. The capacitor C15 improves the operation of the circuitry when the batteries are low and a high current, noisy motor is utilized. Specifically, when the batteries get low, their internal impedance increases which allows noise spikes from some high current types of motors to continue to retrigger the capacitor C12 through the diodes D12 and D13. The capacitor C15 integrates the noise and eliminates the problem. In addition, as the batteries get low, the voltage at the timing capacitor C11 decreases which tends to decrease the length of the motor delay time period. The stored charge in the capacitor C15 provides a large initial current to the timing capacitor C11 when the switch 222 is switched to one of the on positions. The large initial current charges the timing capacitor C11 to peak voltage which keeps the motor delay time period more constant.

The transistor Q11 is preferably a TIP29, 1 amp, npn transistor. The transistors Q12, Q13, and Q15 are preferably 2N3904 npn transistors. The transistor Q14 is preferably 2N3906 pnp transistor.

Figure 19:
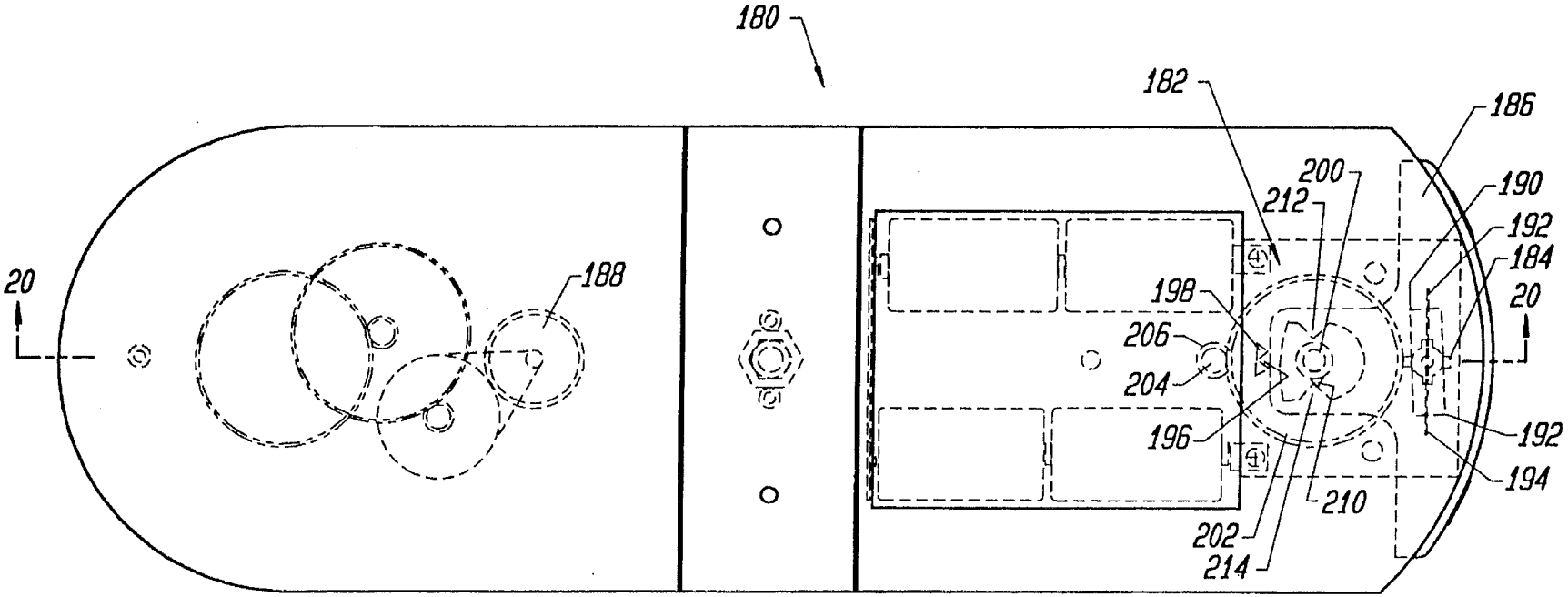
FIG. 19 is a top plan view of an alternative embodiment of a clothing accessory organizer in accordance with the present invention.
Figure 20:
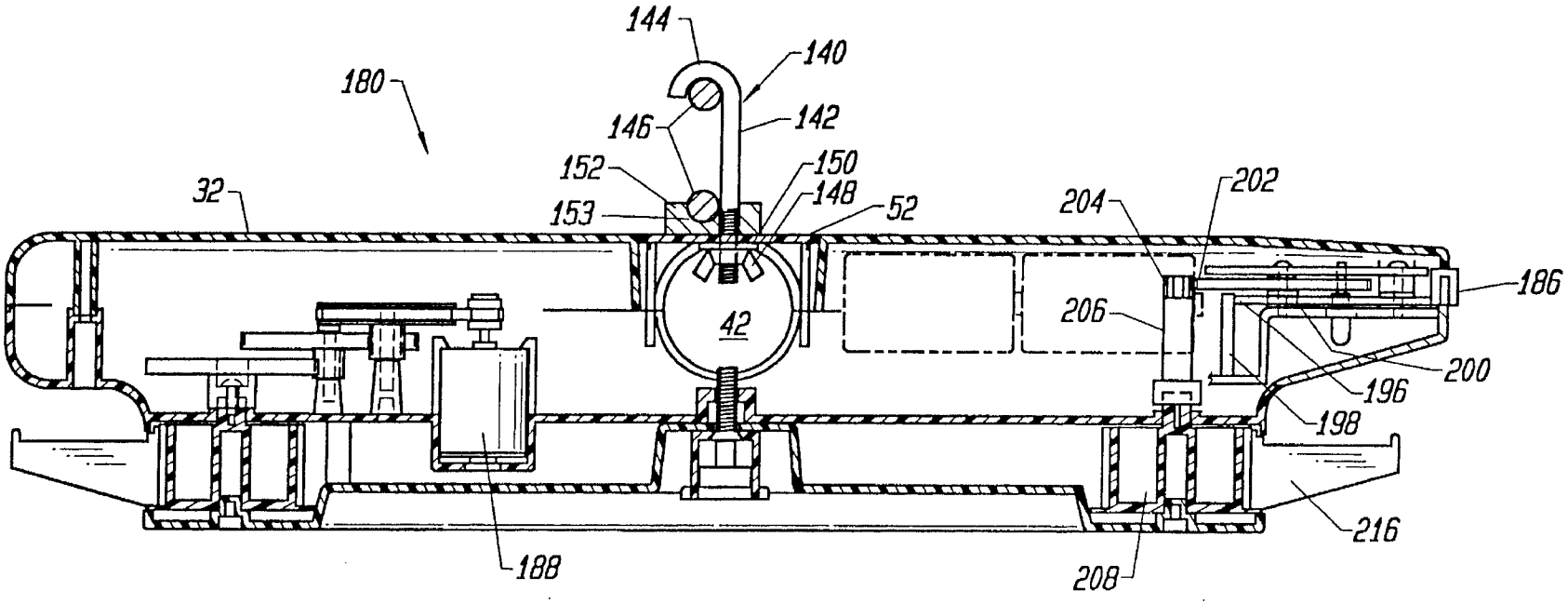
FIG. 20 is a cross-sectional side view taken along line 20—20 in FIG. 19.

Referring to FIGS. 19 and 20, there is illustrated an alternative embodiment of a clothing accessory organizer 180 in accordance with the present invention. The organizer 180 embodies a mechanical implementation of an automatic control system 182 that eliminates the need for much of the circuitry shown in FIGS. 17 and 18.

The automatic control system 182 includes an electric switch 184 which is controlled by a switch bar 186 and is used to connected power to the electric motor 188. The switch 184 is of a different type than the switch 102 described above. The switch 184 includes two contacts 190 and 192 to which the positive and negative battery terminals are connected, respectively. Two more contacts 192 and 194 have the motor 188 inputs connected thereto. When one side of the switch bar 186 is depressed, the contacts 190 and 192 each make contact with a different one of the contacts 192 and 194. When the other side of the switch bar is depressed, the contacts 190 and 192 each make contact with the other one of the contacts 192 and 194. Therefore, the polarity applied to the inputs of the motor 188 is reversed when the opposite side of the switch bar 186 is depressed, resulting in the motor 188 reversing its direction of rotation.

The switch bar 186 has a different configuration than the switch bar 44 described above. Specifically, the switch bar 186 has a notch 196 on its back side that engages a detent 198. The detent 198 holds the switch bar 186 in place when it is depressed on one side. As long as the switch bar 186 is held depressed, the motor 188 continues to run.

A cam 200 is used to push the switch bar 186 out of the detented position to turn the motor 188 off automatically. The cam 200 protrudes from the center of a gear 202 that is rotatably mounted to the housing of the organizer 180. The cam 200 and gear 202 are driven by a small gear 204 secured to one end of a shaft 206 that is driven by the front drum 208. As the front drum 208 rotates, the gear 204 drives the cam 200. A dimple 210 on the cam 200 engages one of two dimples 212 and 214 on the switch bar 186 and pushes it into the off position.

The ratio of the small gear 204 to the gear 202 is such that the cam 200 allows the belt 216 to make up to one complete rotation before automatically switching the motor 188 off. In certain situations, the belt may make much less that one complete rotation if the dimple 210 happens to be positioned very close to one of the dimples 212 or 214.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. An apparatus for organizing articles of clothing, comprising:

a housing;

first and second drums rotatably mounted to the housing;

a belt, engaged around the first and second drums, having a plurality of first hook members for hanging articles thereon, the first hook members being integral with the belt;

a drive mechanism for rotating one of the first and second drums to cause rotation of the belt; and an automatic control device for selective continuous activation of the drive mechanism for a period of time sufficient to enable at least one full rotation of said belt about said first drum and said second drum.

2. An apparatus according to claim 1, wherein:

the drive mechanism comprises an electric motor; and the automatic control mechanism comprises motor delay circuitry for coupling power to the electric motor for a motor delay time period.

3. An apparatus according to claim 2, wherein the motor delay circuitry comprises:

a first transistor for coupling the electric motor to ground;

a first capacitor for providing current that is used to switch the first transistor into a conducting state for an amount of time approximately equal to the motor delay time period; and charging circuitry for charging the first capacitor.

4. An apparatus according to claim 1, further comprising:

an electric switch, mounted to the housing, for coupling power to the drive means; and wherein, the automatic control means comprises a cam rotatably mounted to the housing and driven by one of the first and second drums to trip the electric switch.

5. An apparatus according to claim 1, further comprising:

a light bulb mounted to the housing for illuminating articles hanging on the first hook members; and automatic lighting mechanism for providing electricity to the light bulb for approximately a lamp delay time period.

6. An apparatus according to claim 5, wherein the automatic lighting mechanism comprises:

a second transistor for coupling the light bulb to ground;

a first capacitor for providing current that is used to switch the second transistor into a conducting state for an amount of time approximately equal to the lamp delay time period; and charging circuitry for charging the first capacitor.

7. An apparatus according to claim 1, wherein:

the housing has a cylindrical cavity sized for receiving a closet rod therethrough; and the apparatus further comprises a clamp for clamping the housing to a closet rod that may be inserted through the cylindrical cavity, the clamp having a bolt that is capable of penetrating into the cylindrical cavity, the bolt being countersunk into the housing between the first drum, the second drum, and the belt so as to be accessible from a lower side of the closet rod.

8. An apparatus according to claim 7, wherein the clamp further comprises:

a nut for engaging with the bolt, the nut being positioned adjacent to the cylindrical cavity to guide the bolt into the cylindrical cavity; and a bolt cap slidably mounted over the bolt for rotating the bolt, the bolt cap capable of sliding from a position where it extends outside the housing to a position where it is substantially countersunk in the housing.

9. An apparatus according to claim 1, further comprising:

a plurality of second hook members mounted to the housing between the first and second drums for hanging articles thereon.

10. An apparatus according to claim 1, further comprising:

two wire shelf brackets for mounting the housing to a wire shelf, the brackets comprising elongate bolts having one end inserted into the housing on a side opposite the first and second drums such that they penetrate the cylindrical cavity, the other end of the elongate bolts having a hook shape for engaging a wire shelf.

11. An apparatus according to claim 7, further comprising:

a wall mount bracket for mounting the housing to a wall, the wall mount bracket having an elongate cylindrical rod for engaging with the cylindrical cavity of the housing, the cylindrical rod being attached to a base member that is mountable to a wall.

12. An apparatus according to claim 1, wherein the belt and the hook members are molded as a unitary member out of a plastic material, and the belt being pliably formed while the belt is cooled to align the crystalline structure in the plastic material by driving the belt around two pulleys that each have diameters smaller than the diameter of the first and second drums.

13. An apparatus for organizing articles of clothing, comprising:

a housing;

first and second drums rotatably mounted to the housing;

a belt, engaged around the first and second drums, having a plurality of first hook members for hanging articles thereon;

an electric motor, mounted to the housing, having an output shaft;

a pulley and gear assembly, connected between the output shaft of the electric motor and one of the first and second drums, for rotating one of the first and second drums to cause rotation of the belt;

an electric switch, mounted to the housing and coupled to the electric motor, having three positions for switching the electric motor off, switching the electric motor on so that its output shaft rotates clockwise, and switching the electric motor on so that its output shaft rotates counter-clockwise; and a automatic control device for automatically switching the electric motor off after a motor delay time period sufficient to enable at least one full rotation of said belt about said first drum and said second drum in response to the electric switch being switched to one of the on positions.

14. An apparatus according to claim 13, wherein said control device is further configured to interrupt said motor delay time period upon manual movement of said electric switch from said one of the on positions to the off position to stop operation of said electric motor during said motor delay time period.

15. An apparatus according to claim 13, wherein the automatic control mechanism comprises:

motor delay circuitry responsive to the electric switch for uncoupling power from the electric motor after the motor delay time period.

16. An apparatus according to claim 15, wherein the motor delay circuitry comprises:

a first transistor for coupling the electric motor to ground;

a first capacitor for providing current that is used to switch the first transistor into a conducting state for an amount of time approximately equal to the motor delay time period; and charging circuitry for charging the first capacitor in response to the electric switch being switched to one of the on positions,

17. An apparatus according to claim 13, wherein the automatic control mechanism comprises:

a cam rotatably mounted to the housing and driven by one of the first and second drums to switch the electric switch into the off position.

18. An apparatus according to claim 13, further comprising:

a light bulb mounted to the housing for illuminating articles hanging on the first hook members.

19. An apparatus according to claim 18, further comprising:

an automatic lighting mechanism for providing electricity to the light bulb for approximately a lamp delay time period in response to the electric switch being switched to one of the on positions.

20. An apparatus according to claim 19, wherein the automatic lighting mechanism comprises:

a second transistor for coupling the light bulb to ground;

a first capacitor for providing current that is used to switch the second transistor into a conducting state for an amount of time approximately equal to the lamp delay time period; and charging circuitry for charging the first capacitor in response to the electric switch being switched to one of the on positions.

21. An apparatus according to claim 13, wherein the housing has a cylindrical cavity sized for receiving a closet rod therethrough.

22. An apparatus according to claim 21, further comprising:

a clamp for clamping the housing to a closet rod that may be inserted through the cylindrical cavity, the clamp having a bolt that is capable of penetrating into the cylindrical cavity, the bolt being countersunk into the housing between the first drum, the second drum, and the belt so as to be accessible from a lower side of the closet rod.

23. An apparatus according to claim 22, wherein the clamp further comprises:

a nut for engaging with the bolt, the nut being positioned adjacent to the cylindrical cavity to guide the bolt into the cylindrical cavity; and a bolt cap slidably mounted over the bolt for rotating the bolt, the bolt cap capable of sliding from a position where it extends outside the housing to a position where it is substantially countersunk in the housing.

24. An apparatus according to claim 13, further comprising:

a plurality of second hook members mounted to the housing between the first and second drums for hanging articles thereon.

25. An apparatus according to claim 13, further comprising:

two wire shelf brackets for mounting the housing to a wire shelf, the brackets comprising elongate bolts having one end inserted into the housing on a side opposite the first and second drums such that they penetrate the cylindrical cavity, the other end of the elongate bolts having a hook shape for engaging a wire shelf.

26. An apparatus according to claim 13, further comprising:

a wall mount bracket for mounting the housing to a wall, the wall mount bracket having an elongate cylindrical rod for engaging with the cylindrical cavity of the housing, the cylindrical rod being attached to a base member that is mountable to a wall.

27. An apparatus according to claim 13, wherein the first hook members are integral with the belt.

28. An apparatus according to claim 27, wherein the belt and the hook members are molded as a unitary member out of a plastic material, the belt being pliably formed while the belt is cooled to align the crystalline structure in the plastic material by driving the belt around two pulleys that each have diameters smaller than the diameter of the first and second drums.

29. An apparatus for organizing articles of clothing, comprising:

a housing;

first and second drums rotatably mounted to the housing;

a belt, engaged around the first and second drums, having a plurality of first hook members for hanging articles thereon;

an electric motor, mounted to the housing, having an output shaft;

a pulley and gear assembly, connected between the output shaft of the electric motor and one of the first and second drums, for rotating one of the first and second drums to cause rotation of the belt;

an electric switch, mounted to the housing and coupled to the electric motor, for switching the electric motor on and off;

a light bulb mounted to the housing for illuminating articles hanging on the first hook members; and an automatic lighting device for providing electricity to the light bulb for a lamp delay time period sufficient to enable at least one full rotation of said belt about said first drum and said second drum in response to the electric switch being switched to an on position.

30. An apparatus according to claim 29, wherein the automatic lighting mechanism comprises:

a second transistor for coupling the light bulb to ground;

a first capacitor for providing current that is used to switch the second transistor into a conducting state for an amount of time approximately equal to the lamp delay time period; and charging circuitry for charging the first capacitor in response to the electric switch being switched to one of the on positions.

31. An apparatus according to claim 29, further comprising:

automatic control device for automatically switching the electric motor off after a motor delay time period in response to the electric switch being switched and retained in the on position.

32. An apparatus according to claim 31, wherein the automatic control device comprises:

motor delay circuitry responsive to the electric switch for removing power from the electric motor after the motor delay time period.

33. An apparatus according to claim 32, wherein the motor delay circuitry comprises:

a first transistor for coupling the electric motor to ground;

a first capacitor for providing current that is used to switch the first transistor into a conducting state for an amount of time approximately equal to the motor delay time period; and charging circuitry for charging the first capacitor in response to the electric switch being switched to the on position.

34. An apparatus according to claim 31, wherein the automatic control means comprises:

a cam rotatably mounted to the housing and driven by one of the first and second drums to switch the electric switch into an off position.

35. An apparatus according to claim 29, further comprising:

a plurality of second hook members mounted to the housing between the first and second drums for hanging articles thereon.

36. An apparatus according to claim 29, further comprising:

two wire shelf brackets for mounting the housing to a wire shelf, the brackets comprising elongate bolts having one end inserted into the housing on a side opposite the first and second drums such that they penetrate the cylindrical cavity, the other end of the elongate bolts having a hook shape for engaging a wire shelf.

37. An apparatus according to claim 29, further comprising:

a wall mount bracket for mounting the housing to a wall, the wall mount bracket having an elongate cylindrical rod for engaging with the cylindrical cavity of the housing, the cylindrical rod being attached to a base member that is mountable to a wall.

38. An apparatus according to claim 29, wherein the first hook members are integral with the belt.

39. An apparatus according to claim 38, wherein the belt and the hook members are molded as a unitary member out of a plastic material, the belt being pliably formed while the belt is cooled to align the crystalline structure in the plastic material by driving the belt around two pulleys that each have diameters smaller than the diameter of the first and second drums.

40. An apparatus for organizing articles of clothing, comprising:

a housing having a cylindrical cavity sized for receiving a closet rod therethrough;

first and second drums having first and second axes of rotation, respectively, the first and second drums being rotatably mounted to the housing to permit rotation around the first and second axes, the first and second axes of rotation being positioned substantially parallel to each other;

a belt, engaged around the first and second drums, having a plurality of first hook members for hanging articles thereon, the first hook members extending laterally with respect to the first and second axes of rotation;

a clamp for clamping the housing to a closet rod that may be inserted through the cylindrical cavity, the clamp having a bolt that has its longitudinal axis positioned substantially parallel to the first and second axes so that the bolt is capable of penetrating into the cylindrical cavity, the bolt being countersunk into the housing between the first drum, the second drum, and the belt so as to be accessible from a lower side of the closet rod;

an electric motor, mounted to the housing, having an output shaft;

pulley and gear means, connected between the output shaft of the electric motor and one of the first and second drums, for rotating one of the first and second drums to cause rotation of the belt; and an electric switch, mounted to the housing and coupled to the electric motor, for switching the electric motor on and off.

41. An apparatus according to claim 40, wherein the clamp further comprises:

a nut for engaging with the bolt, the nut being positioned adjacent to the cylindrical cavity to guide the bolt into the cylindrical cavity; and a bolt cap slidably mounted over the bolt for rotating the bolt, the bolt cap capable of sliding from a position where it extends outside the housing to a position where it is substantially countersunk in the housing.

42. An apparatus according to claim 40, further comprising:

automatic control means for automatically switching the electric motor off after a motor delay time period in response to the electric switch being switched and retained in an on position.

43. An apparatus according to claim 42, wherein the automatic control means comprises:

motor delay circuitry responsive to the electric switch for removing power from the electric motor after the motor delay time period; and wherein, the motor delay period of time is equal to an amount of time at least long enough for the belt to make one complete rotation.

44. An apparatus according to claim 43, wherein the motor delay circuitry comprises:

a first transistor for coupling the electric motor to ground;

a first capacitor for providing current that is used to switch the first transistor into a conducting state for an amount of time approximately equal to the motor delay time period; and charging circuitry for charging the first capacitor in response to the electric switch being switched to the on position.

45. An apparatus according to claim 42, wherein the automatic control means comprises:

a cam rotatably mounted to the housing and driven by one of the first and second drums to switch the electric switch into an off position.

46. An apparatus according to claim 40, further comprising:

a plurality of second hook members mounted to the housing between the first and second drums for hanging articles thereon.

47. An apparatus according to claim 40, further comprising:

a wall mount bracket for mounting the housing to a wall, the wall mount bracket having an elongate cylindrical rod for engaging with the cylindrical cavity of the housing, the cylindrical rod being attached to a base member that is mountable to a wall.

48. An apparatus according to claim 40, wherein the first hook members are integral with the belt.

49. An apparatus according to claim 48, wherein the belt and the hook members are molded as a unitary member out of a plastic material, the belt being pliably formed while the belt is cooled to align the crystalline structure in the plastic material by driving the belt around two pulleys that each have diameters smaller than the diameter of the first and second drums.

50. An apparatus for organizing articles of clothing, comprising:

a housing having a cylindrical cavity sized for receiving a closet rod therethrough;

first and second drums having first and second axes of rotation, respectively, the first and second drums being rotatably mounted to the housing to permit rotation around the first and second axes, the first and second axes of rotation being positioned substantially parallel to each other;

a belt, engaged around the first and second drums, having a plurality of first hook members for hanging articles thereon, the first hook members being integral with the belt and extending laterally with respect to the first and second axes of rotation;

a clamp for clamping the housing to a closet rod that may be inserted through the cylindrical cavity, the clamp having a bolt that has its longitudinal axis positioned substantially parallel to the first and second axes so that the bolt is capable of penetrating into the cylindrical cavity, the bolt being countersunk into the housing between the first drum, the second drum, and the belt so as to be accessible from a lower side of the closet rod;

an electric motor, mounted to the housing, having an output shaft;

pulley and gear means, connected between the output shaft of the electric motor and one of the first and second drums, for rotating one of the first and second drums to cause rotation of the belt;

an electric switch, mounted to the housing and coupled to the electric motor, having three detented positions for switching the electric motor off, switching the electric motor on so that its output shaft rotates clockwise, and switching the electric motor on so that its output shaft rotates counter-clockwise; and automatic control means for automatically switching the electric motor off after a motor delay time period in response to the electric switch being switched and retained in one of the detented on positions.

51. An apparatus according to claim 50, wherein the automatic control means comprises:

motor delay circuitry responsive to the electric switch for removing power from the electric motor after the motor delay time period; and wherein, the motor delay period of time is equal to an amount of time at least long enough for the belt to make one complete rotation.

52. An apparatus according to claim 51, wherein the motor delay circuitry comprises:

a first transistor for coupling the electric motor to ground;

a first capacitor for providing current that is used to switch the first transistor into a conducting state for an amount of time approximately equal to the motor delay time period; and charging circuitry for charging the first capacitor in response to the electric switch being switched to one of the detented on positions.

53. An apparatus according to claim 52, further comprising:

a light bulb mounted to the housing for illuminating articles hanging on the first hook members; and automatic lighting means for providing electricity to the light bulb for approximately the motor delay time period in response to the electric switch being switched to one of the detented on positions.

54. An apparatus according to claim 53, wherein the automatic lighting means comprises the light bulb being electrically connected to the collector of the first transistor.

55. An apparatus according to claim 53, wherein the automatic lighting means comprises:

a second transistor for coupling the light bulb to ground;

a third transistor for switching the second transistor into a conducting state; and wherein, the third transistor is switched into a conducting state by the first transistor.

56. An apparatus according to claim 50, wherein the automatic control means comprises:

a cam rotatably mounted to the housing and driven by one of the first and second drums to switch the electric switch into the off position.

57. An apparatus according to claim 50, wherein the clamp further comprises:

a nut for engaging with the bolt, the nut being positioned adjacent to the cylindrical cavity to guide the bolt into the cylindrical cavity; and a bolt cap slidably mounted over the bolt for rotating the bolt, the bolt cap capable of sliding from a position where it extends outside the housing to a position where it is substantially countersunk in the housing.

58. An apparatus according to claim 50, further comprising:

a plurality of second hook members mounted to the housing between the first and second drums for hanging articles thereon.

59. An apparatus according to claim 50, further comprising:

a wall mount bracket for mounting the housing to a wall, the wall mount bracket having an elongate cylindrical rod for engaging with the cylindrical cavity of the housing, the cylindrical rod being attached to a base member that is mountable to a wall.

60. An apparatus according to claim 50, wherein the belt and the hook members are molded as a unitary member out of a plastic material, the belt being pliably formed while the belt is cooled to align the crystalline structure in the plastic material by driving the belt around two pulleys that each have diameters smaller than the diameter of the first and second drums.

61. An apparatus for organizing articles of clothing comprising:

a housing having a cavity formed and dimensioned for sliding receipt of a closet rod therethrough;

first and second drums rotatably mounted to said housing;

a belt engaged around the first and second drums, and having a plurality of hook members for hanging articles thereon; and a clamp formed for clamping said housing to the closet rod received in said cavity, and having a bolt capable of penetrating into said cavity between said first drum, said second drum, and said belt so as to be accessible from a lower side of said closet rod.

62. An apparatus according to claim 61 wherein, said cavity is substantially cylindrical-shaped.

63. An apparatus according to claim 61 wherein, said hook members are formed as a unitary member with the belt.

64. An apparatus according to claim 61 further including:

a drive mechanism for rotating one of the first and second drums to cause rotation of the belt.

65. An apparatus according to claim 61 further including:

a nut for engaging with the bolt, the nut being positioned adjacent to the cylindrical cavity to guide the bolt into the cylindrical cavity to guide the bolt into the cylindrical cavity; and a bolt cap slidably mounted over the bolt for rotating the bolt, the bolt cap capable of sliding from a position where it extends outside the housing to a position where it is substantially countersunk in the housing.

* * * * *

UNITED STATES PATENT AND TRADEMARK OFFICE

CERTIFICATE OF CORRECTION

PATENT NO. : 5,474,187

DATED : December 12, 1995

INVENTOR(S) : Taylor et al.

It is certified that error appears in the above-indentified patent and that said Letters Patent is hereby corrected as shown below:

Column 8, line 59, delete "100K Ω" and insert therefor --100 KΩ--.

Column 8, line 60, delete "220K Ω" and insert therefor --220 KΩ--.

Column 9, line 8, delete "100K Ω" and insert therefor --100 KΩ--.

Column 9, line 10, delete "100K Ω" and insert therefor --100 KΩ--.

Column 9, line 11, delete "100K Ω" and insert therefor --100 KΩ--.

Column 9, line 14, delete "1M Ω" and insert therefor --1 MΩ--.

Column 9, line 51, delete "1M Ω" and insert therefor --1 MΩ--.

Column 10, line 4, delete "1K Ω" and insert therefor --1 KΩ--.

Column 10, line 6, delete "100K Ω" and insert therefor --100 KΩ--.

Column 10, line 7, delete "100K Ω" and insert therefor --100 KΩ--.

Column 11, line 17, delete "100K Ω" and insert therefor --100 KΩ--.

UNITED STATES PATENT AND TRADEMARK OFFICE

CERTIFICATE OF CORRECTION

PATENT NO. : 5,474,187

DATED : December 12, 1995

INVENTOR(S) : Taylor et al.

It is certified that error appears in the above-indentified patent and that said Letters Patent is hereby corrected as shown below:

Column 11, line 27, delete "560K Ω" and insert therefor --560 KΩ--.

Column 11, line 38, delete "560K Ω" and insert therefor --560 KΩ--.

Column 11, line 41, delete "220K Ω" and insert therefor --220 KΩ--.

Column 11, line 52, delete "100K Ω" and insert therefor --100 KΩ--.

Column 11, line 54, delete "100K Ω" and insert therefor --100 KΩ--.

Column 11, line 55, delete "100K Ω" and insert therefor --100 KΩ--.

Column 11, line 67, delete "1M Ω" and insert therefor --1 MΩ--.

Column 12, line 3, delete "1K Ω" and insert therefor --1 KΩ--.

Column 12, line 5, delete "1M Ω" and insert therefor --1 MΩ--.

Column 12, line 17, delete "1M Ω" and insert therefor --1 MΩ--.

Column 12, line 24, delete "1M Ω" and insert therefor --1 MΩ--.

UNITED STATES PATENT AND TRADEMARK OFFICE

CERTIFICATE OF CORRECTION

PATENT NO. : 5,474,187

DATED : December 12, 1995

INVENTOR(S) : Taylor et al.

It is certified that error appears in the above-indentified patent and that said Letters Patent is hereby corrected as shown below:

Claim 2, column 14, line 7, delete "mechanism" and insert therefor --device--.

Claim 5, column 14, line 27, immediately preceding "automatic" insert --an--.

Claim 5, column 14, line 27, delete "mechanism" and insert therefor --device--.

Claim 6, column 14, line 31, delete "mechanism" and insert therefor --device--.

Claim 15, column 15, line 51, delete "mechanism" and insert therefor --device--.

Claim 19, column 16, line 10, delete "mechanism" and insert therefor --device--.

Claim 20, column 16, line 15, delete "mechanism" and insert therefor --device--.

UNITED STATES PATENT AND TRADEMARK OFFICE

CERTIFICATE OF CORRECTION

PATENT NO. : 5,474,187

DATED : December 12, 1995

INVENTOR(S) : Taylor et al.

It is certified that error appears in the above-indentified patent and that said Letters Patent is hereby corrected as shown below:

Claim 30, column 17, line 35, delete "mechanism" and insert therefor --device--.

Claim 61, column 22, line 13, immediately following "drum" delete "," and insert --and--.

Claim 61, column 22, line 14, immediately following "drum" delete --, and said belt--.

Signed and Sealed this

Eighteenth Day of June, 1996

*Attest:*

*Attesting Officer*

BRUCE LEHMAN

*Commissioner of Patents and Trademarks*